US005672563A

United States Patent [19]

Takiguchi et al.

[11] Patent Number: 5,672,563

[45] Date of Patent: Sep. 30, 1997

[54] THERMAL TRANSFER IMAGE-RECEIVING SHEET

[75] Inventors: Ryohei Takiguchi; Hitoshi Saito; Masumi Nishizawa, all of Tokyo, Japan

[73] Assignee: Dai Nippon Printing Co., Ltd., Japan

[21] Appl. No.: 646,816

[22] Filed: May 21, 1996

Related U.S. Application Data

[62] Division of Ser. No. 373,629, Jan. 17, 1995, Pat. No. 5,545,606, which is a division of Ser. No. 216,310, Mar. 23, 1994, Pat. No. 5,405,824, which is a division of Ser. No. 974,738, Nov. 13, 1992, Pat. No. 5,328,888.

[30] Foreign Application Priority Data

| | | | |
|---|---|---|---|
| Nov. 18, 1991 | [JP] | Japan | 3-328307 |
| Dec. 16, 1991 | [JP] | Japan | 3-351811 |
| Feb. 6, 1992 | [JP] | Japan | 4-54129 |
| Mar. 4, 1992 | [JP] | Japan | 4-81456 |
| Apr. 15, 1992 | [JP] | Japan | 4-119873 |
| Sep. 25, 1992 | [JP] | Japan | 4-279247 |

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,929,591 | 5/1990 | Egashira et al. | 503/227 |
| 5,538,831 | 7/1996 | Oshima et al. | 430/201 |

FOREIGN PATENT DOCUMENTS

| | | | |
|---|---|---|---|
| 60-101090 | 5/1985 | Japan | 503/227 |
| 61-54982 | 3/1986 | Japan | 503/227 |
| 61-229594 | 10/1986 | Japan | 503/227 |
| 64-42285 | 2/1989 | Japan | 503/227 |
| 1-204788 | 8/1989 | Japan | 503/227 |
| 2-67193 | 3/1990 | Japan | 503/227 |
| 2-141287 | 5/1990 | Japan | 503/227 |
| 3-126582 | 5/1991 | Japan | 503/227 |

OTHER PUBLICATIONS

Database WPIL, n092-213708, Derwent Publications Ltd, London, GB; & JP-A-4142987 (Dainippon Printing) 15-05-1992.

*Primary Examiner*—Bruce H. Hess

*Attorney, Agent, or Firm*—Parkhurst, Wendel & Burr, L.L.P.

[57] ABSTRACT

The present invention provides a thermal transfer image-receiving sheet capable of forming an image excellent in various types of fastness, particularly in light fastness, maintaining the effect of the ultraviolet absorber during the storage without deterioration and stably existing within a dye-receiving layer through the use of a thermal transfer process wherein use is made of a sublimable dye. The thermal transfer image-receiving sheet of the present invention includes a substrate sheet and a dye-receiving layer formed on at least one surface of the substrate sheet, wherein a layer containing an ultraviolet absorber is provided between the substrate sheet and the dye-receiving layer.

6 Claims, No Drawings

THERMAL TRANSFER IMAGE-RECEIVING SHEET

This is a division of application Ser. No. 08/373,629 filed Jan. 17, 1995, now U.S. Pat. No. 5,545,606, which in turn is a division of application Ser. No. 08/216,310 filed Mar. 23, 1994, now U.S. Pat. No. 5,405,824, issued Apr. 11, 1995, which in turn is a division of Ser. No. 07/974,738 filed Nov. 13, 1992, now U.S. Pat. No. 5,328,888, issued Jul. 12, 1994.

BACKGROUND OF THE INVENTION

The present invention relates to a thermal transfer sheet and more particularly to a thermal transfer image-receiving sheet capable of forming a record image excellent in color density, sharpness and various types of fastness, particularly durability such as light fastness.

Various thermal transfer processes are known in the art. One of them is a transfer process which comprises supporting a sublimable dye as a recording agent on a substrate sheet, such as a polyester film, to form a thermal transfer sheet and forming various full color images on an image-receiving sheet dyeable with a sublimable dye, for example, an image-receiving sheet comprising paper, a plastic film or the like and, formed thereon, a dye-receiving layer.

In this case, a thermal head of a printer is used as heating means, and a number of color dots of three or four colors are transferred to the image-receiving material, thereby reproducing a full color image of an original by means of the multicolor dots.

Since the color material used is a dye, the image thus formed is very clear and highly transparent, so that the resultant image is excellent in reproducibility and gradation, and the quality of the image is the same as that of an image formed by conventional offset printing and gravure printing. In this method, it is possible to form an image having a high quality comparable to a full color photographic image.

Since, however, the resultant image comprises a dye, the light fastness is generally inferior to that of an image comprising a pigment, so that the image rapidly fades or discolors when it is exposed to direct sunlight.

In order to solve the above-described drawbacks, Japanese Patent Laid-Open Publication Nos. 101090/1985, 30735/1985, 54982/1986, 229594/1986 and 141287/1990 disclose a technique wherein an ultraviolet absorber or an antioxidant is incorporated in a dye-receiving layer of the thermal transfer image-receiving sheet.

The addition of the ultraviolet absorber can improve the light fastness to some extent. The method wherein the ultraviolet absorber is merely incorporated in the dye-receiving layer gives rise to a problem that the ultraviolet absorber bleeds out on the surface of the dye receiving layer and disappears or evaporates or decomposes when it is exposed to heat, so that the effect of the ultraviolet absorbers decreases with the elapse of time.

The fading of the dye image is attributable to an incident ultraviolet radiation and further accelerated also by an ultraviolet radiation which passes through a dye receiving layer, reaches the substrate sheet, reflects from the surface of the substrate sheet and again scatters in the dye-receiving layer. The above-described fading derived from the reflected light from the substrate sheet cannot be prevented by a simple method wherein an ultraviolet absorber is added on the dye-receiving layer or incorporated in the dye-receiving layer.

In particular, if the substrate sheet of the thermal transfer sheet is a white sheet, such as paper, there is a limitation on the effect when an ultraviolet absorber is incorporated in the dye receiving layer. Studies conducted by the present inventors have revealed that the ultraviolet radiation passed through the dye-receiving layer reflects again from the surface of the white substrate sheet and the reflected ultraviolet radiation irregularly reflects within the receiving layer to lower the light fastness of the image.

SUMMARY OF THE INVENTION

An object of the present invention is to provide a thermal transfer image-receiving sheet capable of forming an image excellent in various types of fastness, particularly in light fastness, maintaining the effect of the ultraviolet absorber during the storage without deterioration and having excellent durability through the use of a thermal transfer process wherein use is made of a sublimable dye.

The above-described object can be attained by the following present invention.

According to the first aspect of the present invention, there is provided a thermal transfer image-receiving sheet comprising a substrate and a dye-receiving layer formed on at least one surface of the substrate sheet, wherein a layer comprising an ultraviolet absorber is interposed between the substrate sheet and the dye-receiving layer.

The provision of a layer containing an ultraviolet absorber between the substrate sheet and the dye-receiving layer can provide a thermal transfer image-receiving sheet wherein a thermal transfer image having a light fastness can be formed and the ultraviolet absorber can stably exist within the dye-receiving layer during storage.

According to the second aspect of the present invention, there is provided a thermal transfer image-receiving sheet comprising a substrate sheet and a dye-receiving layer formed on at least one surface of the substrate sheet, wherein said dye-receiving layer contains an ultrafine particle of ZnO having a hexagonal system and/or an ultrafine $TiO_2$ particle of $TiO_2$; a thermal transfer image-receiving sheet comprising a substrate sheet and a dye-receiving layer formed on at least one surface of the substrate sheet, wherein a layer comprising an ultrafine particle of ZnO having a hexagonal system and/or an ultrafine particle of $TiO_2$ is provided on the dye-receiving layer; and a thermal transfer image-receiving sheet comprising a substrate sheet and a dye-receiving layer formed on at least one surface of the substrate sheet, wherein a layer having a capability of absorbing an ultraviolet radiation is provided between the substrate sheet and the dye image-receiving layer.

The incorporation of an ultraviolet absorber comprising an inorganic ultrafine particle in a dye-receiving layer, the formation of a layer containing the ultraviolet absorber on the surface of the dye-receiving layer or the provision of a layer having a capability of absorbing an ultraviolet radiation between the substrate sheet and the dye-receiving layer can provide a thermal transfer image-receiving sheet which can form a thermal transfer image having excellent light fastness, is free from the bleedout of the ultraviolet absorber on the surface of the dye-receiving layer even during storage and can cut off ultraviolet radiation reflected from the white substrate sheet.

In order to solve the above-described drawback, Japanese Patent Laid-Open Publication Nos. 101090/1985, 130735/1985, 54982/1986, 229594/1986 and 141287/1990 disclose that an ultraviolet absorber or an antioxidant is incorporated in the dye-receiving layer of the thermal transfer image-receiving sheet.

The addition of the ultraviolet absorber contributes to an improvement in the light fastness to some extent. The method wherein the ultraviolet absorber is merely incorporated in the dye-receiving layer gives rise to a problem that the ultraviolet absorber bleeds out on the surface of the dye receiving layer and disappears or evaporates or decomposes when it is exposed to heat, so that the effect of the ultraviolet absorbers decreases with the elapse of time.

An object of the present invention is to provide a thermal transfer image-receiving sheet capable of forming an image excellent in various types of fastness, particularly in light fastness, maintaining the effect of the ultraviolet absorber during the storage without deterioration and capable of stably existing in the dye-receiving layer through the use of a thermal transfer process wherein use is made of a sublimable According to the third aspect of the present invention, there is provided a thermal transfer image-receiving sheet comprising a substrate sheet and a dye-receiving layer formed on at least one surface of the substrate sheet, wherein the dye-receiving layer contains an ultraviolet absorber reacted with and bonded to a dye-receiving resin and/or an additive.

The bonding of a reactive ultraviolet absorber to the dye-receiving layer through a reaction can provide a thermal transfer image-receiving sheet wherein a thermal transfer image having a light fastness can be formed and the ultraviolet absorber can stably exist within the dye-receiving layer during storage.

According to the fourth embodiment of the present invention, there is provided a thermal transfer image-receiving sheet comprising a substrate sheet and a dye-receiving layer formed on at least one surface of the substrate sheet, wherein the dye-receiving layer contains at least one compound represented by the following general formulae (1) and/or (2).

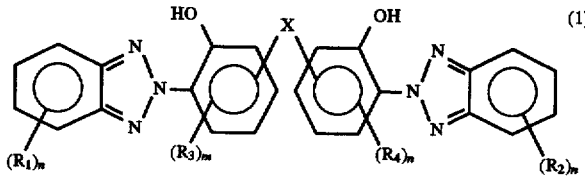

(1)

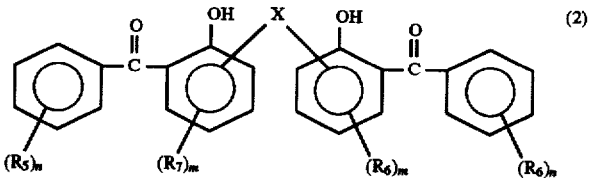

(2)

wherein $R_1$ to $R_8$ each independently stand for a hydrogen atom, a halogen atom, a $C_1$–$C_{12}$ alkoxy group, a $C_7$–$C_{13}$ arylalkoxy group, a $C_1$–$C_{10}$ alkyl group, a cycloalkyl group, an arylalkyl group, an aryl group, a thioalkoxy group, a thioaryloxy group, an alkylcarbonyl group, an alkyloxycarbonyl group, an alkylsulfonyl group, an alkylaminocarbonyl group, a nitro group, an amino group, an alkylamino group or a heterocyclic group, n is an integer of 0 to 4 and m is an integer of 1 to 3, provided that $R_1$ to $R_8$ may be the same or different, X stands for $=C(R_9)(R_{10})$, $—R_{11}—CO—Y—CO—R_{12}—$ or a straight-chain or branched alkylene group interrupted by at least one Z, Y stands for $—O—R_{13}—O—$, Z stands for —O—, —CO—, —CO—O—, —OC—O—, —S—, —SO—, $—SO_2—$, —NHCONH—, —NHCO— or —CONH—, $R_9$ to $R_{12}$ each independently stand for a hydrogen atom, a $C_1$–$C_{10}$ alkyl group, a cycloalkyl group, an arylalkyl group or an aryl group and $R_{13}$ stands for a straight-chain or branched alkylene group.

The incorporation of an ultraviolet absorber having a particular structure in the dye-receiving layer can provide a thermal transfer image-receiving sheet wherein a thermal transfer image having a light fastness can be formed and the ultraviolet absorber can stably exist within the dye-receiving layer during storage.

According to the fifth embodiment of the present invention, there is provided a thermal transfer image-receiving sheet comprising a substrate sheet and a dye-receiving layer formed on at least one surface of the substrate sheet, wherein the dye-receiving layer contains at least one compound represented by the following general formulae (1) to (4).

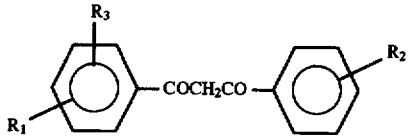

(1)

(benzoylmethane derivative)

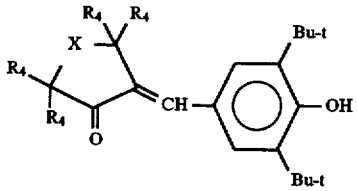

(2)

(benzylidene derivative)

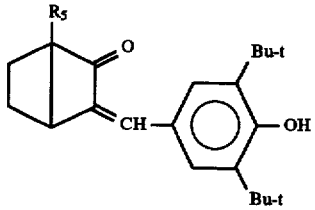

(3)

(benzylidene derivative)

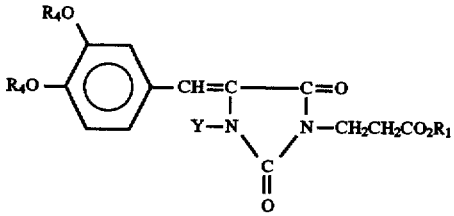

(4)

(hydantoin derivative)

wherein $R_1$, $R_2$ and $R_3$ each stand for a hydrogen atom, a $C_1$–$C_{12}$ alkoxy group, a $C_1$–$C_{10}$ alkyl group, a cycloalkyl group, an arylalkyl group, an aryl group, a carboxyl group, a hydroxyl group, an alkylcarbonyl group, an alkylcarboxy group or a polyoxyalkylene oxide group; X stands for an oxygen atom or a NH group; $R_5$ stands for an alkylene group ($C_1$–$C_{10}$) or $CH_2SO_3H$, $R_4$ stands for an alkyl group ($C_1$–$C_3$) and Y stands for a hydrogen atom or $—CH_2CH_2CO_2R_1$.

The incorporation of the ultraviolet absorber having a particular structure in the dye-receiving layer can provide a thermal transfer image-receiving sheet wherein a thermal transfer image having a light fastness can be formed and the ultraviolet absorber can stably exist within the dye-receiving layer during storage.

DETAILED DESCRIPTION OF THE INVENTION

The present invention will now be described in more detail with reference to the following preferred embodiments of the present invention.

First Embodiment

The thermal transfer image-receiving sheet of the first embodiment comprises a substrate sheet and, formed thereon in the following order, an ultraviolet absorber layer and a dye-receiving layer.

There is no particular limitation on the substrate sheet used in the present invention, and examples of the substrate sheet useable in the present invention include synthetic paper (polyolefin, polystyrene and other synthetic paper), wood free paper, art paper, coat paper, cast coat paper, wall paper, paper for backing, paper impregnated with a synthetic resin or an emulsion, paper impregnated with a synthetic rubber latex, paper containing an internally added synthetic resin, fiber board, etc., cellulose fiber paper, and films or sheets of various plastics such as polyolefin, polyvinyl chloride, polyethylene terephthalate, polystyrene, polymethacrylate and polycarbonate. Further, use may be made of a white opaque film or a foamed sheet prepared by adding a white pigment or filler to the above-described synthetic resin.

Further, use may be made of a laminate comprising any combination of the above-described substrate sheets. Typical examples of the laminate include a laminate comprising a combination of a cellulose fiber paper with a synthetic paper and a laminate comprising a combination of a cellulose fiber paper with a plastic film or sheet. The thickness of these substrate sheets may be arbitrary and is generally in the range of from 10 to 300 μm.

When the substrate sheet is poor in the adhesion to a dye-receiving layer formed on the surface thereof, it is preferred that the surface of the substrate sheet be subjected to a primer treatment or a corona discharge treatment.

The ultraviolet absorber layer serves to absorb an ultraviolet radiation passed through the dye-receiving layer and an ultraviolet radiation reflected from the surface of the substrate sheet to cut off the ultraviolet radiation.

The above-described ultraviolet absorber layer can be formed by coating a coating solution comprising an ultraviolet absorber and a binder resin on the surface of a substrate sheet and drying the resultant coating. The binder resin may be any resin having a film forming property, such as a thermoplastic resin for constituting a dye-receiving layer which will be described later and may be a thermosetting resin.

Examples of the ultraviolet absorber added to the ultraviolet absorber layer include salicylic acid, benzophenone, benzotriazole, cyanoacrylate and other ultraviolet absorber. More specific examples of the ultraviolet absorber include phenyl salicylate, p-octylphenyl salicylate, p-tert-butylphenyl salicylate, 2,4-dihydroxybenzophenone, 2-hydroxy-4-methoxybenzophenone, 2,2'-dihydroxy-4-methoxy-benzophenone, 2,2'-dihydroxy-4,4'-dimethoxybenzophenone, 2,2'-dihydroxy-4,4'-dimethoxy-5-sulfonebenzophenone, 2-hydroxy-4-n-octoxybenzophenone, 4-dodecyloxy-2-hydroxybenzophenone, 2-(2'-hydroxy-3', 5'-di-tert-butyl-phenyl)-benzotriazole, 2-(2'-hydroxy-3'-tert-butyl-5'-methyl-phenyl)-5-chlorobenzotriazole, 2-(2'-hydroxy-3',5'-di-tert-butyl-phenyl)-5-chlorobenzotriazole, 2-(2'-hydroxy-4'-n-octoxyphenyl)benzotriazole, and ethyl-2-cyano-3,3-diphenyl acrylate.

The ultraviolet absorber layer is formed by coating a suitable organic solvent solution or water or organic solvent dispersion of a mixture of a suitable binder resin with the ultraviolet absorber and other necessary additives, for example, by a gravure printing method, a screen printing method or a reverse roll coating method wherein use is made of a gravure print, and drying and heating the resultant coating.

The thickness of the ultraviolet absorber layer is preferably in the range of from 0.05 to 5 μm. With respect to the amount of addition of the ultraviolet absorber, a useful mixing ratio is determined by the thickness of the ultraviolet absorber layer and the kind of the compound, and the addition of the ultraviolet absorber layer in a volume proportion of 0.1 to 30% to the ultraviolet absorber layer provides Good results.

The dye-receiving layer formed on the surface of the ultraviolet absorber layer serves to receive a sublimable dye migrating from the thermal transfer sheet and to maintain the formed image.

Examples of the resin for forming the dye-receiving layer include a polyolefin resin such as polypropylene, a halogenated polymer such as polyvinyl chloride or polyvinylidene chloride, a vinyl polymer such as polyvinyl acetate or polyacrylic acid ester, a polyester resin such as polyethylene terephthalate or polybutylene terephthalate, a polystyrene resin, a polyamide resin, a resin of a copolymer of an olefin such as ethylene or propylene with other vinyl monomer, an ionomer, a cellulose resin such as cellulose diacetate and a polycarbonate resin. Among them, a vinyl resin, a polycarbonate resin and a polyester resin are particularly preferred.

These resins may be used also in the form of a water dispersion prepared by a conventional method. If necessary, the receiving layer may be cured by means of heat, an ionizing radiation or the like.

The thermal transfer image-receiving sheet of the present invention can be produced by coating at least one surface of the substrate sheet with a suitable organic solvent solution or water or organic solvent dispersion of a mixture of the above-described resin with necessary additives such as a release agent, for example, by a gravure printing method, a screen printing method or a reverse roll coating method wherein use is made of a gravure print, and drying the resultant coating to form a dye-receiving layer.

In the formation of the dye-receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

In the present invention, in addition to the above-described UV absorption layer, the conventional or following UV absorber may be further incorporated in the receiving layer.

The image-receiving sheet of the present invention can be applied to various applications where thermal transfer recording can be conducted, such as cards and sheets for preparing transparent originals, by properly selecting the substrate sheet.

Further, in the image-receiving sheet of the present invention, a cushion layer may be optionally provided between the substrate sheet and the receiving layer. Since the provision of a cushion layer enables the thermal transfer sheet to be sufficiently adhered to the image-receiving sheet by a pressure applied during printing, neither dropout of transfer nor uneven density under an identical printing condition occurs, so that it becomes possible to conduct transfer of an image, a letter, etc. in a clear form and free from faults.

Examples of the resin used in the cushion layer include a polyurethane resin, an acrylic resin, a polyethylene resin, a butadiene rubber and an epoxy resin. The thickness of the cushion layer is preferably in the range of from about 2 to 20 μm. A layer serving both as an UV absorption layer and a cushion layer can be provided by incorporating the above-described UV absorber in the above-described cushion layer.

It is also possible to provide a lubricant layer on the reverse face of the substrate sheet. Examples of the material for the lubricant layer include a methacrylate resin such as methyl methacrylate or a corresponding acrylate resin and a vinyl resin such as a vinyl chloride/vinyl acetate copolymer.

Further, it is possible to provide a detection mark on the image-receiving sheet. The detection mark is very convenient for a registration between the thermal transfer sheet and the image-receiving sheet. For example, a detection mark detectable by means of a photocell detector can be provided on the reverse face or other face of the substrate sheet by means of printing or other method.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 mJ/mm$^2$ through the control of a recording time by means of a recording device, for example, a thermal printer (for example, a video printer VY-100 manufactured by Hitachi, Limited).

Second Embodiment

The thermal transfer image-receiving sheet of the second embodiment comprises a substrate sheet and, formed on at least one surface of the substrate sheet, a dye-receiving layer containing a particular ultraviolet absorber. The substrate sheet may be the same as that used in the first embodiment.

The dye-receiving layer formed on the surface of the substrate sheet serves to receive a sublimable dye migrating from the thermal transfer sheet and to maintain the formed image.

The resin for constituting the dye-receiving layer may be the same as that used in the first embodiment.

One preferred example of the ultraviolet absorber comprising an inorganic ultrafine particle and added to the dye-receiving layer is a ZnO fine particle of a hexagonal system wherein the particle diameter 400 Å or less, preferably 200 Å or less. When the particle diameter exceeds 400 Å, the dye-receiving layer becomes opaque, which is detrimental to the transparency of the dye-receiving layer. The purity of the ZnO fine particle of a hexagonal system is preferably 96% or more. When the purity is less than 96%, the dye-receiving layer often becomes opaque due to impurities.

Another example of the ultraviolet absorber comprising an inorganic ultrafine particle is an ultrafine particle of $TiO_2$. The particle diameter of the ultrafine particle is 500 Å or less, preferably 300 Å or less. A typical process for producing the ultraviolet absorber comprising an inorganic ultrafine particle is roughly classified into a liquid phase process and a gaseous phase process, and the ultraviolet absorber is produced by providing hydrous titanium oxide prepared by a gaseous phase oxidation of titanium tetrachloride or a neutralization precipitation reaction or a thermal hydrolysis of a titanium salt and subjecting the hydrous titanium oxide to a deflocculation treatment with hydrochloric acid, nitric acid, acetic acid or the like. Further, it is also possible to use an ultrafine particle having a surface coated with silica.

In the above-described ultrafine particles of ZnO and $TiO_2$, the ultraviolet radiation absorption wavelength can be controlled by crystalline structure or doping metal. Further, ultrafine particles of ZnO and $TiO_2$ having a surface subjected to a treatment for rendering the surface hydrophobic may also be used for the purpose of incorporating the ultrafine particle into the dye-receiving layer, particularly for the purpose of homogeneously dispersing the ultrafine particle in a resin having a high affinity for a dye, for example, a polyester resin, a polyvinyl chloride resin, a polycarbonate resin or a polyvinyl butyral resin. Examples of the surface treatment method include a treatment with a silane coupling agent, a titanate surface treatment, a siloxane or a surfactant.

The UV absorbers useable in the present invention are commercially available, and examples of such UV absorbers include FINEX-25 (manufactured by Sakai Chemical Industry Co., Ltd.), ZnO-100, ZNO-200 and ZnO-300 (manufactured by Sumitomo Cement Co., Ltd.), ultrafine titanium oxide particle TTO-55 series (TTO-55(A), TTO-55(B), TTO-55(C) and TTO-55(S) (manufactured by Ishihara Sangyo Kaisha Ltd.) and titania sol CS-C and CS-N (manufactured by Ishihara Sangyo Kaisha Ltd.).

The above-described ultrafine particle having a capability of absorbing an ultraviolet radiation is preferably added or used in a proportion of 10 to 400% by weight to the resin solid matter constituting the dye-receiving layer, and the proportion is still preferably in the range of from 30 to 200% by weight.

The thermal transfer image-receiving sheet of the present invention can be produced by coating at least one surface of the substrate sheet with a suitable organic solvent solution or water or organic solvent dispersion of a mixture of the above-described resin with the above-described ultraviolet absorber of an ultrafine particle and necessary additives such as a release agent, for example, by a gravure printing method, a screen printing method or a reverse roll coating method wherein use is made of a gravure print, and drying the resultant coating to form a dye-receiving layer.

In the formation of the dye-receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Since these pigments or fillers have a large particle diameter, they have no capability of absorbing an ultraviolet radiation as opposed to the particles used in the present invention.

Although the thickness of the dye-receiving layer formed by the above-described method may be arbitrary, it is generally in the range of from 1 to 50 μm. It is preferred for the dye-receiving layer to comprise a continuous coating.

However, the dye-receiving layer may be formed as a discontinuous coating through the use of a resin emulsion or a resin dispersion.

The thermal transfer sheet according to another embodiment is characterized in that a layer comprising an ultrafine ZnO particle of a hexagonal system and/or an ultrafine $TiO_2$ particle is provided on the dye-receiving layer. Such an ultraviolet absorber layer can be formed by coating a coating solution comprising a solution or emulsion containing a binder which is the same as the dye-receiving layer resin or a hydrophilic binder (PVA, PVP, polyhydroxyethyl polyacrylate, polyacrylic acid, etc.) and, added thereto, the above-described ultraviolet absorber so that the thickness on a solid basis is about 0.1 to 5 μm. It is a matter of course that the ultraviolet absorber layer should not be opaque.

The thermal transfer sheet according to a further embodiment is characterized in that a layer having a capability of absorbing an ultraviolet radiation is provided between the substrate sheet and the dye-receiving layer. Such an ultraviolet absorber layer can be formed by coating a coating solution comprising a solution or emulsion containing a binder which is the same as the dye-receiving layer resin and, added thereto, a proper ultraviolet absorber so that the thickness on a solid basis is about 0.2 to 2.0 μm. Although the ultraviolet absorption layer is preferably transparent, it need not be necessarily transparent.

Although the amount of use of the above-described ultraviolet absorber may vary depending upon the kind of the ultraviolet absorber, it is preferably such that a reflected light in a wavelength region of 350 to 380 nm reflected from the substrate sheet surface after passing though the receiving layer is cut off by70% or more, preferably 90% or more. The proportion of the ultraviolet absorber to the resin (on a solid basis) constituting the ultraviolet absorption layer is preferably 10 to 400% by weight, preferably 30 to 200% by weight.

The above-described UV absorber according to the present invention may be added to the receiving layer or used in the form of an UV absorption layer provided on the receiving layer or an UV absorption layer provided between the substrate sheet and the receiving layer. A combination of some of these embodiments exhibits an excellent effect. The provision of an UV absorption layer between the substrate sheet and the receiving layer is particularly effective.

Further, it is also possible to use an embodiment wherein an UV absorption layer containing an UV absorber according to the present invention is provided between the receiving layer and the substrate sheet, and the conventional UV absorber or following dimer UV absorber or reactive UV absorber is incorporated in the receiving layer.

The image-receiving sheet of the present invention can be applied to various applications where thermal transfer recording can be conducted, such as continuous sheets, flat sheets, cards and sheets for preparing transparent originals, by properly selecting the substrate sheet.

Further, in the thermal transfer image-receiving sheet of the present invention, a cushion layer may be optionally provided between the substrate sheet and the dye-receiving layer. Since the provision of a cushion layer enables the thermal transfer sheet to be sufficiently adhered to the image-receiving sheet by virtue of a pressure applied during printing, neither dropout of transfer nor uneven density under an identical printing condition occurs, so that it becomes possible to conduct transfer of an image, a letter, etc. in a clear form and free from faults.

Examples of the resin used in the cushion layer include a polyurethane resin, an acrylic resin, a polyethylene resin, a butadiene rubber and an epoxy resin. The thickness of the cushion layer is preferably in the range of from about 2 to 20 μm. A layer serving both as an UV absorption layer and a cushion layer can be provided by incorporating the above-described UV absorber in the above-described cushion layer.

It is also possible to provide a lubricant layer on the reverse face of the substrate sheet. Examples of the material for the lubricant layer include a methacrylate resin such as methyl methacrylate or a corresponding acrylate resin and a vinyl resin such as a vinyl chloride/vinyl acetate copolymer.

Further, it is possible to provide a detection mark on the image-receiving sheet. The detection mark is very convenient for a registration between the thermal transfer sheet and the image-receiving sheet. For example, a detection mark detectable by means of a photocell detector can be provided on the reverse face or other face of the substrate sheet by means of printing or other method.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 $mJ/mm^2$ through the control of a recording time by means of a recording device, for example, a thermal printer (for example, a video printer VY-100 manufactured by Hitachi, Limited).

Third Embodiment

The thermal transfer image-receiving sheet of the third embodiment comprises a substrate sheet and, formed on at least one surface of the substrate sheet, a dye-receiving layer.

The substrate sheet may be the same as that used in the first embodiment.

The dye-receiving layer formed on the surface of the substrate sheet may be the same as that used in the first embodiment.

In the present invention, the reactive ultraviolet absorber added to the dye-receiving layer comprises a conventional non-reactive ultraviolet absorber and, introduced thereinto, for example, an addition-polymerizable double bond (a vinyl group, a (meth)acryloyl group or the like), an alcoholic hydroxyl group, an amino group, a carboxyl group, an epoxy group or an isocyanate group. These reactive groups may be introduced into the conventional non-reactive ultraviolet absorber by a known method. Some examples of the reactive ultraviolet absorber favorable in the present invention will now be described. However, the present invention is not limited to these specific examples only.

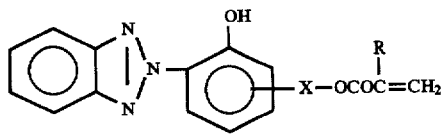

(1)

wherein R=H or $CH_3$ and X=—$OCH_2CH_2$— or

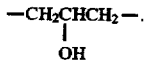

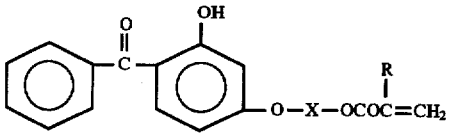

(2)

wherein R=H or $CH_3$ and X=—$CH_2CH_2$— or

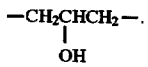

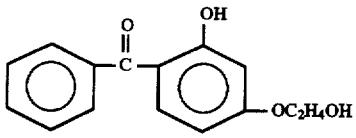

(3)

The proportion of use of the reactive ultraviolet absorber to the other component constituting the dye-receiving layer is preferably in the range of from 1 to 20%, still preferably in the range of from 5 to 10%. When the amount of use is less than 1% by weight, it is difficult to attain a satisfactory light fastness. On the other hand, when the amount of use exceeds 20% by weight, there occurs an unfavorable phenomenon such that the face of the dye-receiving layer becomes sticky or the thermal transfer image becomes greasy.

Various methods may be applied to the fixation of the reactive ultraviolet absorber within the receiving layer. Some specific examples thereof will now be described. One method comprises incorporating a reactive ultraviolet absorber into a coating solution for forming a dye-receiving layer, forming a dye-receiving layer and bonding the reactive ultraviolet absorber to the resin for forming a receiving layer through a reaction by electron beam irradiation. In this case, it is preferred to use reactive ultraviolet absorbers containing an addition-polymerizable double bond, such as those represented by the general formulae (1) and (2). In this case, it is preferred to use add and mix an ordinary addition-polymerizable monomer or oligomer.

When an ultraviolet radiation is used instead of the electron beam, it is necessary to use the ultraviolet absorber in combination with an ultraviolet polymerization initiator.

Examples of the above-described monomer or oligomer include monofunctional monomers and polyfunctional monomers such as methyl (meth)acrylate, ethyl (meth) acrylate, ethylhexyl (meth)acrylate, styrene, methylstyrene and N-vinylpyrrolidone, for example, trimethylolpropane tri(meth)acrylate, hexanediol di(meth)acrylate, tripropylene glycol di(meth)acrylate, diethylene glycol di(meth)acrylate, pentaerythritol tri(meth)acrylate, dipentaerythritol hexa (meth)acrylate, 1,6-hexanediol di(meth)acrylate, neopentyl glycol penta(meth)acrylate and phosphazene hexa(meth) acrylate. Further, it is also possible to use reactive polymers produced by a reaction of (meth)acrylic acid or its functional derivative, such as polyester (meth)acrylate, epoxy (meth) acrylate, urethane (meth)acrylate, polyether (meth) acrylate. The amount of use of these monomers and oligomers is preferably 90 to 10:10 to 90 in terms of the weight ratio of the monomers and oligomers to the above-described thermoplastic resin.

When an ultraviolet radiation is used as means for the reaction bonding, it is possible to add and mix polymerization initiators such as acetophenones, benzophenone, Michler's benzoyl benzoate, α-amyloxime esters, tetramethylthiuram monosulfide and thioxanthone and photosensitizers such as n-butylamine, triethylamine, tri-n-butylphosphine.

Conventional techniques, as such, are applicable to the reaction bonding. For example, in the case of reaction bonding by means of an electron beam, use my be made of an electron beam having an energy of 50 to 1,000 KeV, preferably 100 to 300 KeV emitted from various electron beam accelerators such as Kockcroft Walton, van de Graaff, resonance transformation, insulation core transformer, linear, dynatron and high frequency and other electron beam accelerators, and in the case of reaction bonding by means of an ultraviolet radiation, use may be made of an ultraviolet radiation emitted from light sources such as an extra-high pressure mercury lamp, a high pressure mercury lamp, a low pressure mercury lamp, a carbon arc, a xenon arc and a metal halide lamp.

When the reactive ultraviolet absorber is a compound having a hydroxyl group or other reactive group, for example, a mercapto group, an amino group, a carboxyl group, an epoxy group or an isocyanate group, such as a compound represented by the formula (3), thermoplastic resins having a group reactive with the above-described reactive group (i.e., resins produced by introducing a suitable reactive group into the above-described resins for constituting the receiving layer, for example, a saturated polyester resin, an acrylic resin, a cellulose resin, for example, ethyl cellulose, cellulose acetate butyrate, cellulose acetate propionate or ethylhydroxy cellulose, a vinyl chloride/vinyl acetate/vinyl alcohol copolymer, a vinyl chloride/vinyl acetate/hydroxyethyl acrylate copolymer and a polyvinyl acetal resin) may be used as the resin for constituting the receiving layer, and the reactive ultraviolet absorber can be fixed through a reaction to the thermoplastic resin by means of heat or the like optionally in the presence of a catalyst. In this case, combined use of a suitable amount of a crosslinking agent, such as polyisocyanate is preferred.

Any known organic polyisocyanatemay be used. Preferred examples of the organic polyisocyanate include toluene-2,4-diisocyanate, 4-methoxy-1,3-phenylenediisocyanate, 4-isopropyl-1,3-phenylenediisocyanate, 4-chloro-1,3-phenylenediisocyanate, 4-butoxy-1,3-phenylenediisocyanate, 2,4-diisocyanato-diphenyl ether, methylenediisocyanate, 4,4-methylenebis (phenylisocyanate), durylenediisocyanate, 1,5-naphthalenediisocyanate, benzidinediisocyanate, o-nitrobenzidinediisocyanate, 4,4-diisocyanatedibenzyl, 1,4-tetramethylenediisocyanate, 1,6-tetramethylenediisocyanate, 1,10-decamethylenediisocyanate, 1,4-cyclohexylenediisocyanate, xylylenediisocyanate, 4,4-methylenebis(cyclohexylisocyanate) and 1,5-tetrahydronaphthalenediisocyanate.

Further, it is a matter of course that use may be made of adducts of the above-described organic polyisocyanates with other compound, isocyanate adducts produced by reacting the above-described organic isocyanates with a low-molecular weight polyol or polyamine in such a manner that the terminal is an isocyanate, and other adducts.

It is preferred for these polyisocyanates to be used in such an amount that the equivalent ratio of the functional group of other component constituting the receiving layer to the NCO group is 1:1 to 1:0.1.

The fixation of the reactive ultraviolet absorber to the thermoplastic resin through a reaction by means of the above-described polyisocyanate or the like may be conducted by a mere heat treatment optionally in the presence of a catalyst.

The thermal transfer image-receiving sheet of the present invention can be produced by coating at least one surface of the substrate sheet with a suitable organic solvent solution or water or organic solvent dispersion of a mixture of the above-described resin with the above-described ultraviolet absorber of an ultrafine particle and optional additives, for example, by a gravure printing method, a screen printing method or a reverse roll coating method wherein use is made of a gravure print, drying and heating the resultant coating, to form a dye-receiving layer, and further exposing the coating to an electron beam, an ultraviolet radiation, heat or the like to bond the reactive ultraviolet absorber to the thermoplastic resin and/or additive through a reaction, thereby forming a dye-receiving layer.

It is preferred for the dye-receiving layer to contain a releasing agent for the purpose of imparting a good releasability from the thermal transfer sheet. Preferred examples of the releasing agent include silicone oil, phosphoric ester surfactants and fluorosurfactants. The amount of addition of the releasing agent is preferably 0.1 to 20 parts by weight based on 100 parts by weight of the binder resin. When the amount of addition is outside this range, there is a possibility that problems such as fusion of the thermal transfer sheet to the dye-receiving layer or a lowering in the printing sensitivity occurs. Although the thickness of the dye-receiving layer formed by the above-described method may be arbitrary, it is generally in the range of from 1 to 50 μm.

In the formation of the dye-receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

When the releasing agent has a reactive group, it becomes possible to bond the releasing agent to the resin constituting the receiving layer through a reaction as with the fixation of the reactive ultraviolet absorber through a reaction. Examples of the reactive releasing agent include those having as a reactive group an addition-polymerizable double bond, an alcoholic hydroxyl group, a mercapto group, an amino group, a carboxy group, an epoxy group or an isocyanate group, and more specific examples thereof include the following compounds. The reaction bonding of the reactive releasing agent may be conducted in the same manner as that used in the reaction bonding of the reactive ultraviolet absorber.

(1) Amino-modified silicone oil:

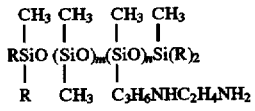

wherein m=1–10, n=2–10 and R=$CH_3$ or $OCH_3$.

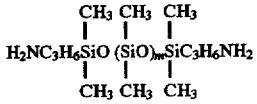

wherein m=0–200.

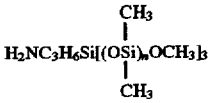

wherein n=2–10.

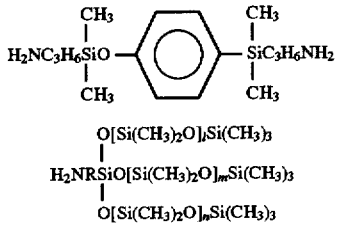

wherein branching points=2–3, R=lower alkyl group, l=2–200, m=2–200 and n=2–200.

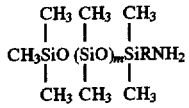

m=1–200 and R=lower alkyl group.

(2) Epoxy-modified silicone oil:

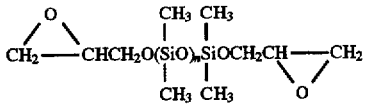

wherein n=1 to 200.

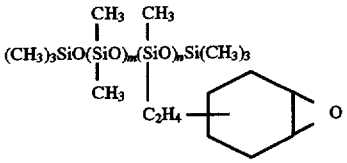

wherein m=1–10 and n=2 to 10.

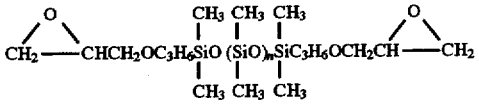

wherein n=1 to 200.

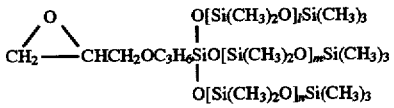

wherein branching points=2 to 3, R=lower alkyl group, l=2–200, m=2–200 and n=2–200.

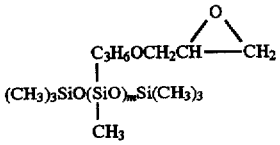

wherein m=1–10.

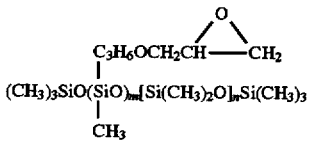

wherein m=1–10 and n=2–10.

(3) Alcohol-modified silicone oil:

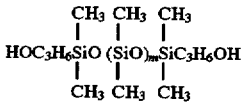

wherein n=1–200.

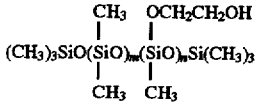

wherein m=1–10 and n=2–10.

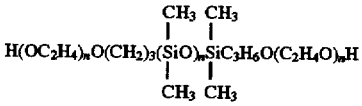

wherein n=0–200.

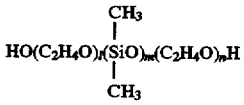

wherein l=1–10, m=10–200 and n=1–5.

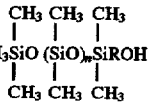

wherein n=1–200 and R=lower alkyl group.

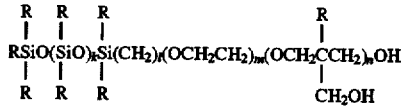

wherein R=lower alkyl group, R'=hydrogen atom or alkyl group, k=1–250, l=0–5, m=0–50 and n=1–3.

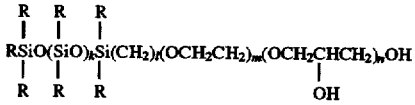

wherein R=lower alkyl group, R'=hydrogen atom or alkyl group, k=1–250, l=0–5, m=0–50 and n=2–3.

(4) Mercapto-modified silicone oil:

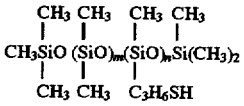

wherein m=1–10 and n=2–10.

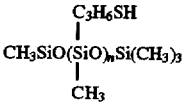

wherein n=2 to 10.

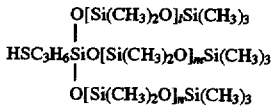

wherein branching points=2–3, R=lower alkyl group, l=2–200, m=2–200 and n=2–200.

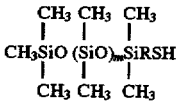

wherein m=1–200 and R=lower alkyl group.

(5) Carboxyl-modified silicone oil:

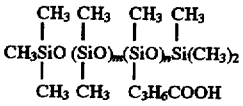

wherein m=1–10 and n=2–10.

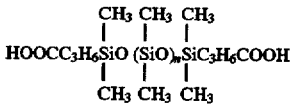

wherein n=1–200.

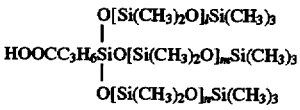

wherein branching points=2–3, R=lower alkyl group, l=2–200, m=2–200 and n=2–200.

(6) Vinyl-modified silicone oil:

Compounds having a vinyl group or (meth)acryloyl group introduced through the utilization of a reactive group of the above-described reactive releasing agents (1) to (5).

Further, it is also possible to form a release layer on the receiving layer by using a reactive release agent. Similarly, a reactive UV absorber may be immobilized through a reaction on the release layer.

The image-receiving sheet of the present invention can be applied to various applications where thermal transfer recording can be conducted, such as thermal transfer sheets, cards and sheets for preparing transparent originals, by properly selecting the substrate sheet.

Further, in the thermal transfer image-receiving sheet of the present invention, a cushion layer may be optionally provided between the substrate sheet and the dye-receiving layer, and the provision of the cushion layer enables an image less susceptible to noise during printing and corresponding to image information to be formed by transfer recording with a good reproducibility.

Examples of the resin used in the cushion layer include a polyurethane resin, an acrylic resin, a polyethylene resin, a butadiene rubber and an epoxy resin. The thickness of the cushion layer is preferably in the range of from about 2 to 20 μm.

It is also possible to provide a lubricant layer on the reverse face of the substrate sheet. Examples of the material for the lubricant layer include a methacrylate resin such as methyl methacrylate or a corresponding acrylate resin and a vinyl resin such as a vinyl chloride/vinyl acetate copolymer.

Further, it is possible to provide a detection mark on the image-receiving sheet. The detection mark is very convenient for a registration between the thermal transfer sheet and the image-receiving sheet. For example, a detection mark detectable by means of a photocell detector can be provided on the reverse face or other face of the substrate sheet by means of printing or other method.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 mJ/mm$^2$ through the control of a recording time by means of a recording device, for example, a thermal printer (for example, a video printer VY-100 manufactured by Hitachi, Limited).

Fourth Embodiment

The thermal transfer image-receiving sheet of the fourth embodiment comprises a substrate sheet and a dye-receiving layer formed on at least one surface of the substrate sheet.

The substrate sheet and the dye-receiving layer may be the same as those of the first embodiment.

In the present invention, preferred examples of the ultraviolet absorber added to the dye-receiving layer include benzotriazole and benzophenone dimers represented by the above-described general formulae. Particularly preferred examples of the ultraviolet absorber include benzotriazole and benzophenone ultraviolet absorbers represented by the following compounds 1-a and 1-b and compound 2.

Compound 1-a

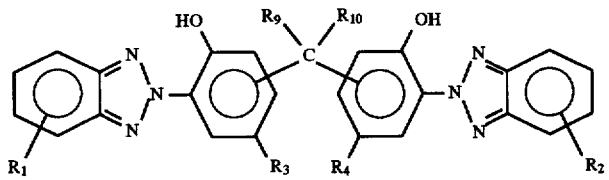

Compound 1-b

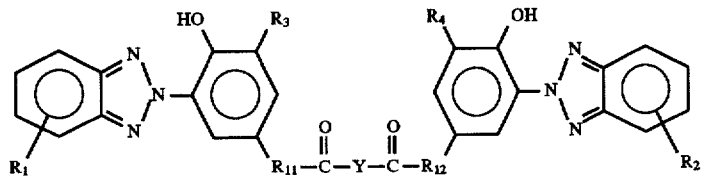

Compound 1-c

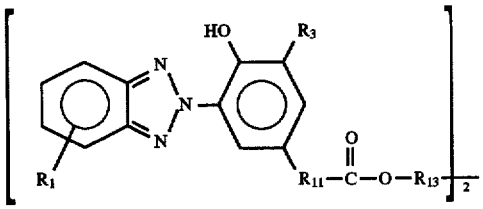

Compound 2

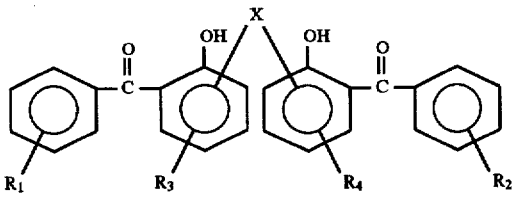

The proportion of use of the reactive ultraviolet absorber to the resin (on a solid basis) constituting the dye-receiving layer is preferably in the range of from 1 to 20%, still preferably in the range of from 5 to 10%. When the amount of use is less than 1% by weight, it is difficult to attain a satisfactory light fastness. On the other hand, when the amount of use exceeds 20% by weight, there occurs an unfavorable phenomenon such that the face of the dye-receiving layer becomes sticky or the thermal transfer image becomes greasy.

All the compounds represented by the general formulae 1 and 2 are useful in the present invention. Particularly preferred examples of the compound are represented in terms of their substituents and given in the following Tables D1 to D4.

TABLE D1

(Compound 1-a)

| No. | $R_1$ | $R_2$ | $R_3$, $R_4$ | $R_9$ | $R_{10}$ |
|---|---|---|---|---|---|
| 1 | —H | —H | —$CH_3$ | —H | —H |
| 2 | —H | —H | —$C(CH_3)_2CH_2C(CH_3)_3$ | —H | —H |
| 3 | —H | —H | cumyl | —H | —H |
| 4 | —H | —H | —$C_8H_{17}$ | —H | —H |
| 5 | —H | —H | —$CH_3$ | —H | —$C_7H_{15}$ |
| 6 | —Cl | —Cl | —$CH_3$ | —H | —$C_7H_{15}$ |

TABLE D2

(Compound 1-b)

| No. | $R_1$, $R_2$ | $R_3$, $R_4$ | $R_{11}$, $R_{12}$ | Y |
|---|---|---|---|---|
| 1 | —H | —$C(CH_3)_3$ | —$CH_2CH_2$— | —$OCH_2CH_2O$— |
| 2 | —H | —$C(CH_3)_3$ | —$CH_2CH_2$— | —O—$(CH_2CH_2O)_2$— |
| 3 | —H | —$C(CH_3)_3$ | —$CH_2CH_2$— | —O—$(CH_2CH_2O)_3$— |
| 4 | —H | —$C(CH_3)_3$ | —$CH_2CH_2$— | —O—$(CH_2CH_2O)_4$— |
| 5 | —H | —$C(CH_3)_3$ | —$CH_2CH_2$— | —$O(CH_2CH_2O)_m$— wherein m = 5–7 |
| 6 | —H | —$C(CH_3)_3$ | —$CH_2CH_2$— | —O—$[CH_2CH(CH_3)O]_2$— |
| 7 | —H | —$C(CH_3)_3$ | —$CH_2CH_2$— | —O—$[CH_2CH(CH_3)O]_3$— |
| 8 | —Cl | —$C(CH_3)_3$ | —$CH_2CH_2$— | —O—$(CH_2CH_2O)_3$— |
| 9 | —Cl | —$C(CH_3)_3$ | —$CH_2CH_2$— | —O—$(CH_2CH_2O)_m$— wherein m = 5–7 |

| | $R_1$ | $R_2$ | $R_3$, $R_4$ | $R_{11}$, $R_{12}$ | Y |
|---|---|---|---|---|---|
| 10 | —Cl | —H | —$C(CH_3)_3$ | —$CH_2CH_2$— | —O—$CH_2CH_2O$— |
| 11 | —Cl | —H | —$C(CH_3)_3$ | —$CH_2CH_2$— | —O—$(CH_2CH_2O)_3$— |
| 12 | —Cl | —H | —$C(CH_3)_3$ | —$CH_2CH_2$— | —O—$(CH_2CH_2O)_m$— wherein m = 5–7 |

| | $R_1$, $R_2$ | $R_3$, $R_4$ | $R_{11}$, $R_{12}$ | Y |
|---|---|---|---|---|
| 13 | —H | —$CH_3$ | —$CH_2CH_2$— | —O—$(CH_2CH_2O)_2$— |
| 14 | —H | —$CH_3$ | —$CH_2CH_2$— | —O—$(CH_2CH_2O)_4$— |
| 15 | —H | —$CH_3$ | —$CH_2CH_2$— | —O—$(CH_2CH_2O)_m$— wherein m = 8–10 |

TABLE D3

(Compound 1-c)

| No. | $R_1$ | $R_3$ | $R_{11}$ | $R_{13}$ |
|---|---|---|---|---|
| 1 | —H | —H | —$CH_2CH_2$— | —$(CH_2CH_2O)_m$—$[CH(CH_3)CH_2O]_n$— wherein m and n represent an integer of 1 to 30. |
| 2 | —Cl | —H | —$CH_2CH_2$— | —$(CH_2CH_2O)_m$—$[CH(CH_3)CH_2O]_n$— wherein m and n represent an integer of 1 to 30. |
| 3 | —H | —$C(CH_3)_3$ | —$CH_2CH_2$— | —$(CH_2CH_2O)_m$—$[CH(CH_3)CH_2O]_n$— wherein m and n represent an integer of 1 to 30. |
| 4 | —Cl | —$C(CH_3)_3$ | —$CH_2CH_2$— | —$(CH_2CH_2O)_m$—$[CH(CH_3)CH_2O]_n$— wherein m and n represent an integer of 1 to 30. |
| 5 | —H | t-$C_5H_{11}$ | —$CH_2CH_2$— | —$(CH_2CH_2O)_m$—$[CH(CH_3)CH_2O]_n$— wherein m and n represent an integer of 1 to 30. |
| 6 | —Cl | t-$C_5H_{11}$ | —$CH_2CH_2$— | —$(CH_2CH_2O)_m$—$[CH(CH_3)CH_2O]_n$— wherein m and n represent an integer of 1 to 30. |

TABLE D4

(Compound 2)

| No. | $R_5$, $R_6$ | $R_7$, $R_8$ | X |
|---|---|---|---|
| 1 | —H | —OH | —$CH_2$— |
| 2 | —H | —$OCH_3$ | —$CH_2$— |
| 3 | —COOH | —$OCH_3$ | —$CH_2$— |
| 4 | —H | —$OC_8H_{17}$ | —$CH_2$— |
| 5 | —H | —$OCH_2Ph$ | —$CH_2$— |
| 6 | —Cl | —$OCH_3$ | —$CH_2$— |
| 7 | —H | —$OCOCH_3$ | —$CH_2$— |
| 8 | —OH —$OCH_3$ | —$(OH)_2$ | —$CH_2$— |
| 9 | —H | —OCOPh | —$CH_2$— |
| 10 | —H | —$OCOC_7H_{15}$ | —$CH_2$— |
| 11 | —H | —$OCH_3$ | —S— |
| 12 | —H | —$OC_{10}H_{21}$ | —$SO_2$— |
| 13 | —H | —$OCH_3$ | —$C(CH_3)_2$— |
| 14 | —OH | —$OC_8H_{17}$ | —$CH(C_3H_7)$— |
| 15 | —H | —$OCH_3$ | —$(C_2H_4COOH)C(CH_3)$— |
| 16 | —H | —H | —$O(CH_2)_4O$— |
| 17 | —H | —H | —$O(CH_2)_6O$— |
| 18 | —H | —H | —$O(CH_2)_2$—O—$(CH_2)_2O$— |
| 19 | —Cl | —H | —$O(CH_2)_4O$— |
| 20 | —$CH_3$ | —H | —$O(CH_2)_4O$— |
| 21 | —H | —H | —$OCH_2$—Ph—$CH_2O$— |
| 22 | —H | —H | —$O(CH_2)_2NHCONH(CH_2)_2O$— |
| 23 | —H | —H | —OPh—NHCONH—PhO— |

The thermal transfer image-receiving sheet the present invention can be produced by coating at least one surface of the substrate sheet with a suitable organic solvent solution or water or organic solvent dispersion of a mixture of the above-described resin with the above-described ultraviolet absorber and necessary additives such as a release agent, for example, by a gravure printing method, a screen printing method or a reverse roll coating method wherein use is made of a gravure print, and drying the resultant coating to form a dye-receiving layer.

In the formation of the dye-receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

Further, the UV absorber according to the present invention may be provided as an UV absorption layer between the substrate sheet and the receiving layer through the use of a binder which is the same as the receiving layer resin.

The image-receiving sheet of the present invention can be applied to various applications where thermal transfer recording can be conducted, such as cards and sheets for preparing transparent originals, by properly selecting the substrate sheet.

Further, in the image-receiving sheet of the present invention, a cushion layer may be optionally provided between the substrate sheet and the receiving layer. Since the provision of a cushion layer enables the thermal transfer sheet to be sufficiently adhered to the image-receiving sheet by virtue of a pressure applied during printing, neither dropout of transfer nor uneven density under an identical printing condition occurs, so that it becomes possible to conduct transfer of an image, a letter, etc. in a clear form and free from faults.

A layer serving both as an UV absorption layer and a cushion layer can be provided by incorporating the above-described UV absorber in the above-described cushion layer.

Examples of the resin used in the cushion layer include a polyurethane resin, an acrylic resin, a polyethylene resin, a butadiene rubber and an epoxy resin. The thickness of the cushion layer is preferably in the range of from about 2 to 20 μm.

It is also possible to provide a lubricant layer on the reverse face of the substrate sheet. Examples of the material for the lubricant layer include a methacrylate resin such as methyl methacrylate or a corresponding acrylate resin and a vinyl resin such as a vinyl chloride/vinyl acetate copolymer.

Further, it is possible to provide a detection mark on the image-receiving sheet. The detection mark is very convenient for a registration between the thermal transfer sheet and the image-receiving sheet. For example, a detection mark detectable by means of a photocell detector can be provided on the reverse face or other face of the substrate sheet by means of printing or other method.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 mJ/mm$^2$ through the control of a recording time by means of a recording device, for example, a thermal printer (for example, a video printer VY-100 manufactured by Hitachi, Limited).

Fifth Embodiment

The thermal transfer image-receiving sheet of the fifth embodiment comprises a substrate sheet and a dye-receiving layer formed on at least one surface of the substrate sheet.

The substrate sheet and the dye-receiving layer may be the same as those of the first embodiment.

In the present invention, preferred examples of the ultraviolet absorber added to the dye-receiving layer include benzoylmethane derivatives, benzylidene derivatives and hydantoin derivatives represented by the above-described general formulae (1) to (4). Particularly preferred examples of the ultraviolet absorber include those represented by the following formulae [I] to [VI].

[I]

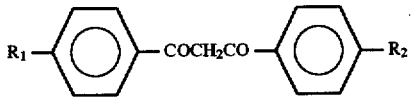

[II]

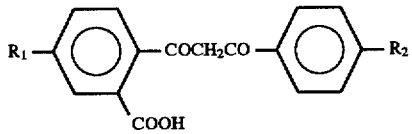

[III]

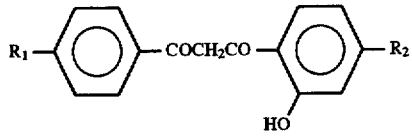

[IV]

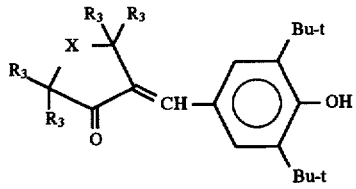

[V]

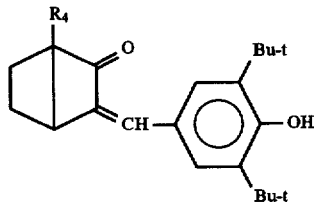

[VI]

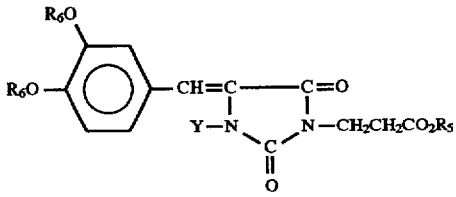

In the above-described formulae, $R_1$ and $R_2$ stand for a straight-chain or branched alkyl group, a hydrogen atom, a hydroxyl group or a $C_{1-C8}$ alkoxy group. $R_3$ stands for a methyl group or an ethyl group. X stands for an oxygen atom or NH, $R_4$ stands for a methyl group or $CH_2SO_3H$, $R_5$ stands for a $C_{1-C8}$ straight-chain or branched alkyl group, $R_6$ stands for a methyl group or an ethyl group and Y stands for $CH_2CH_2CO_2R_5$ or a hydrogen atom.

The proportion of use of the reactive ultraviolet absorber to the resin (on a solid basis) constituting the dye-receiving layer is preferably in the range of from 1 to 20%, still preferably in the range of from 5 to 10%. When the amount of use is less than 1% by weight, it is difficult to attain a satisfactory light fastness. On the other hand, when the amount of use exceeds 20% by weight, there occurs an unfavorable phenomenon such that the face of the dye-receiving layer becomes sticky or the thermal transfer image becomes greasy.

All the compounds represented by the general formulae 1 to 4 are useful in the present invention. Particularly preferred examples of the compound are represented in terms of their substituents and given in the following Tables E1 and E2.

TABLE E1

| Compound (I) | | |
|---|---|---|
| No. | $R_1$ | $R_2$ |
| No. 1 | —H | —H |
| No. 2 | -t-Bu | —$OCH_3$ |
| No. 3 | -iso-Pro | —H |
| No. 4 | -t-Bu | —OH |
| **Compound (II)** | | |
| No. | $R_1$ | $R_2$ |
| No. 5 | —H | —$OCH_3$ |
| No. 6 | -t-Bu | —$OCH_3$ |
| No. 7 | —H | —O-(-$CH_2CH_2O)_2H$ |
| **Compound (III)** | | |
| No. | $R_1$ | $R_2$ |
| No. 8 | -t-Bu | —$OCH_3$ |
| No. 9 | -iso-Pro | —$OCH_3$ |
| No. 10 | -t-Bu | —O-(-$CH_2CH_2O)_2H$ |
| **Compound (IV)** | | |
| No. | $R_3$ | X |
| No. 11 | —$CH_3$ | —O— |
| No. 12 | —$C_2H_5$ | —NH— |
| No. 13 | —$C_2H_5$ | —O— |

TABLE E2

| Compound (V) | |
|---|---|
| No. | $R_4$ |
| No. 14 | —$CH_3$ |
| No. 15 | —$CH_2SO_4H$ |

| Compound (VI) | | | |
|---|---|---|---|
| No. | $R_5$ | $R_6$ | Y |
| No. 16 | —$CH_2CH(C_2H_5)C_4H_9$ | —$CH_3$ | —H |
| No. 17 | —$C_2H_5$ | —$CH_3$ | —$CH_2CH_2CO_2C_2H_5$ |
| No. 18 | —$CH_2CH(C_2H_5)C_4H_9$ | —$CH_3$ | —$CH_2CH(C_2H_5)C_4H_9$ |

The thermal transfer image-receiving sheet of the present invention can be produced by coating at least one surface of the substrate sheet with a suitable organic solvent solution or water or organic solvent dispersion of a mixture of the above-described resin with the above-described ultraviolet absorber and necessary additives such as a release agent, for example, by a gravure printing method, a screen printing method or a reverse roll coating method wherein use is made of a gravure print, and drying and heating the resultant coating to form a dye-receiving layer.

In the formation of the dye-receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

The image-receiving sheet of the present invention can be applied to various applications where thermal transfer recording can be conducted, such as cards and sheets for preparing transparent originals, by properly selecting the substrate sheet.

Further, in the image-receiving sheet of the present invention, a cushion layer may be optionally provided between the substrate sheet and the receiving layer, and the provision of the cushion layer enables an image less susceptible to noise during printing and corresponding to image information to be formed by transfer recording with a good reproducibility.

Examples of the resin used in the cushion layer include a polyurethane resin, an acrylic resin, a polyethylene resin, a butadiene rubber and an epoxy resin. The thickness of the cushion layer is preferably in the range of from about 2 to 20 μm.

It is also possible to provide a lubricant layer on the reverse face of the substrate sheet. Examples of the material for the lubricant layer include a methacrylate resin such as methyl methacrylate or a corresponding acrylate resin and a vinyl resin such as a vinyl chloride/vinyl acetate copolymer.

Further, it is possible to provide a detection mark on the image-receiving sheet. The detection mark is very convenient for a registration between the thermal transfer sheet and the image-receiving sheet. For example, a detection mark detectable by means of a photocell detector can be provided on the reverse face or other face of the substrate sheet by means of printing or other method.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 mJ/mm$^2$ through the control of a recording time by means of a recording device, for example, a thermal printer (for example, a video printer VY-100 manufactured by Hitachi, Limited).

The present invention will now be described in more detail with reference to the following Examples and Comparative Examples. In the Examples and Comparative Examples, "parts" or "%" is by weight unless otherwise specified.

EXAMPLE A1

Synthetic paper (Yupo-FRG-150 (thickness: 150 μm) manufactured by Oji-Yuka Synthetic Paper Co., Ltd.) was used as the substrate sheet, and a coating solution having the following composition was coated by means of a bar coater so that the coverage on a dry basis was 3 g/m$^2$, and the resultant coating was dried to provide an ultraviolet absorber layer.

| Composition of coating solution | |
|---|---|
| Polycarbonate resin represented by the following structural formula | 10.0 parts |
| Ultraviolet absorber represented by the following structural formula | 3.0 parts |
| Chloroform | 90.0 parts |

Polycarbonate:

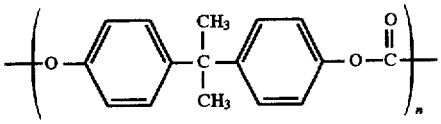

(Number average molecular weight: 14,200)

Ultraviolet absorber:

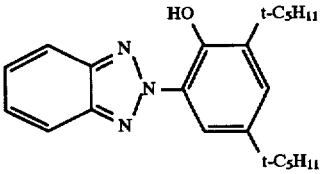

Then, a coating solution having the following composition was coated on the surface of the formed ultraviolet absorber layer so that coated by means of a bar coater so that the coating thickness on a dry basis was 2.0 μm, and the resultant coating was dried to form a dye-receiving layer, thereby providing the thermal transfer image-receiving sheet of the present invention.

| Composition of coating solution | |
|---|---|
| Polyester resin (Vylon 200 manufactured by Toyobo Co., Ltd.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Methyl ethyl ketone/toluene (weight ratio = 1/1) | 90.0 parts |

EXAMPLE A2

The thermal transfer sheet of the present invention was prepared in the same manner as that of Example A1, except that an ultraviolet absorber having the following structural formula was used in instead of the ultraviolet absorber used in Example A1.

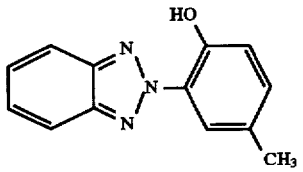

EXAMPLE A3

The thermal transfer sheet of the present invention was prepared in the same manner as that of Example A1, except that an ultraviolet absorber having the following structural formula was used in instead of the ultraviolet absorber used in Example A1.

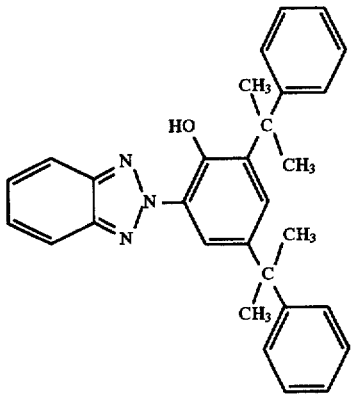

EXAMPLE A4

The thermal transfer sheet of the present invention was prepared in the same manner as that of Example A1, except that an ultraviolet absorber having the following structural formula was used instead of the ultraviolet absorber used in Example A1.

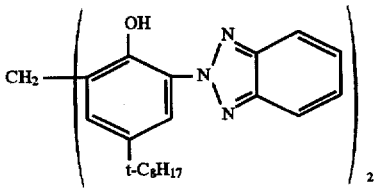

EXAMPLE A5

The thermal transfer sheet of the present invention was prepared in the same manner as that of Example A1, except that an ultraviolet absorber having the following structural formula was used instead of the ultraviolet absorber used in Example A1.

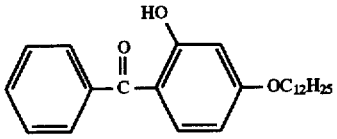

EXAMPLE A6

The thermal transfer sheet of the present invention was prepared in the same manner as that of Example A1, except that an ultraviolet absorber having the following structural formula was used in instead of the ultraviolet absorber used in Example A1.

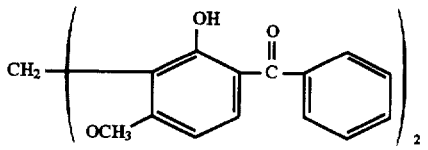

Comparative Example A1

A coating solution having the following composition was coated by means of a bar coater on one surface of the same substrate sheet as that of Example A1 so that the coating thickness on a dry basis was 5 μm, thereby providing a comparative thermal transfer image-receiving sheet.

| Composition of coating solution | |
|---|---|
| Polyester resin (Vylon 200 manufactured by Toyobo Co., Ltd.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Methyl ethyl ketone/toluene (weight ratio = 1/1) | 90.0 parts |

An ink composition for forming a dye-supporting layer was prepared according to the following formulation, coated by means of a gravure printing method on a 6 μm-thick polyethylene terephthalate film having a reverse face subjected to a treatment for imparting heat resistance so that the coverage on a dry basis was 1.0 g/m$^2$, and the resultant coating was dried to provide thermal transfer sheets.

| Ink composition | |
|---|---|
| Cyan dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

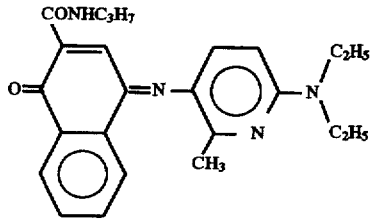

Thermal transfer test

The above-described thermal transfer sheet and the above-described thermal transfer image-receiving sheet of the present invention or comparative thermal transfer image-receiving sheet were put on top of the other in such a manner that the dye layer and the dye receiving surface faced each other. Recording of a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and the durability and storage stability of the formed image were then determined. The results are given in the following Table A1. Various types of performance given in Table A1 were evaluated by the following methods.

(1) Light fastness test:

Irradiation of the print was conducted by means of a xenon fadeometer (Ci-35A manufactured by Atlas) at 400 Kj/m$^2$ and 500 KJ/m$^2$, the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

⊙: Retention was 70% or more.

○: Retention was 60 to 70% exclusive.

Δ: Retention was 50 to 60% exclusive.

X: Retention was 40 to 50% exclusive.

XX: Retention was less than 40%.

(2) Spectral reflectance of thermal transfer image-receiving sheet:

An integrating sphere attachment (internal type: 60 mmø; equipped with a photomultiplier tube $R_{928}$) was inserted into a sample chamber of Shimadzu self-recording spectrophotometer UV-240, and the spectral reflectance of reflected light from the substrate sheet of the thermal transfer image-receiving sheet was measured.

TABLE A1

| | Retention after xenon irradiation (%) | | Spectral reflect- |
|---|---|---|---|
| | 400 KJ/m$^2$ | 500 KJ/m$^2$ | ance |
| Ex. A1 | ⊙ | ○ | 7 |
| Ex. A2 | ○ | ○ | 18 |
| Ex. A3 | ⊙ | ○ | 12 |
| Ex. A4 | ⊙ | ○ | 11 |
| Ex. A5 | ⊙ | ○ | 9 |
| Ex. A6 | ○ | ○ | 15 |
| Comp. Ex. A1 | X | XX | 96 |

As described above, according to the present invention, the provision of a layer containing an ultraviolet absorber between the substrate sheet and the dye-receiving layer can provide a thermal transfer image-receiving sheet wherein a thermal transfer image having a light fastness can be formed and the ultraviolet absorber can stably exist within the dye-receiving layer also during storage.

EXAMPLE B1

Synthetic paper (Yupo-FRG-150 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coating thickness on a dry basis was 5.0 μm, and the resultant coating was dried to form a dye-receiving layer, thereby providing the thermal transfer image-receiving sheet of the present invention.

| Composition of coating solution | |
|---|---|
| Polyester resin (Vylon 200 manufactured by Toyobo Co., Ltd.) | 20.0 parts |
| Ultrafine particle ZnO (ZnO-100; particle diameter: 50 to 150 Å; manufactured by Sumitomo Cement Co., Ltd.) | 20.0 parts |
| Catalytic crosslinking silicone (X-62-1212 manufactured by The Shin-Etsu Chemical Co., Ltd.) | 2.0 parts |
| Platinum-based curing catalyst (PL-50T manufactured by The Shin-Etsu Chemical Co., Ltd.) | 0.2 part |
| Methyl ethyl ketone/toluene (weight ratio = 1/1) | 160.0 parts |

An ink composition for forming a dye layer was prepared according to the following formulation, coated by means of a gravure printing method on a 6 μm-thick polyethylene terephthalate film having a reverse face subjected to a treatment for rendering the face heat-resistant so that the coverage on a dry basis was 1.0 g/m$^2$, and the resultant coating was dried to provide thermal transfer sheets.

| Ink composition | |
|---|---|
| Cyan dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

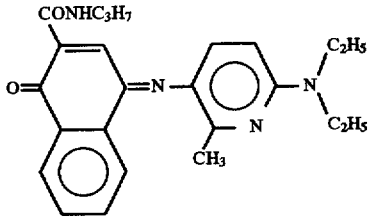

Thermal transfer test

The above-described thermal transfer sheet and the above-described thermal transfer image-receiving sheet of the present invention or comparative thermal transfer image-receiving sheet were put on top of the other in such a manner that the dye layer and the dye receiving surface faced each other. Recording of a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and the durability and storage stability of the formed image were then determined. The results are given in the following Table B1.

Various types of performance Given in Table B1 were evaluated by the following methods.

(1) Light fastness test:

Irradiation of the print was conducted by means of a xenon fadeometer (Ci-35A manufactured by Atlas) at 400 KJ/m$^2$ and 500 KJ/m$^2$, the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

⊙: Retention was 70% or more.

○: Retention was 60 to 70% exclusive.

Δ: Retention was 50 to 60% exclusive.

X: Retention was 40 to 50% exclusive.

XX: Retention was less than 40%.

(2) Storage stability of thermal transfer sheet:

The storage stability was expressed in terms of the difference in the retention between when printing was conducted immediately after the thermal transfer sheet was prepared by the above-described method and the light fastness test was conducted and when the light fastness test was conducted after storage in an oven of 60° C. for 7 days. The results are given in Table B1.

○: No change in the retention was observed.

X: Reduction in the retention was observed.

Comparative Example B1

A comparative thermal transfer image-receiving sheet was prepared in the same manner as that of Example B1, except that no ultrafine particle of ZnO was used, and the formation of an image and the evaluation of the formed image was conducted in the same manner as that of Example B1.

Comparative Example B2

A comparative thermal transfer image-receiving sheet was prepared in the same manner as that of Example B1, except that 2.0 parts of an organic ultraviolet absorber (Tinuvin-P manufactured by Ciba-Geigy Aktiengesellschaft) was used instead of the ultrafine particle of ZnO, and the formation of an image and the evaluation of the formed image were conducted in the same manner as that of Example B1.

Comparative Example B3

A comparative thermal transfer image-receiving sheet was prepared in the same manner as that of Example B1, except that 2.0 parts of an organic ultraviolet absorber (Chemisorb 10 manufactured by Chemipuro Kasei K.K.) was used instead of the ultrafine particle of ZnO, and the formation of an image and the evaluation of the formed image was conducted in the same manner as that of Example B1.

EXAMPLES B2 TO B4

Thermal transfer image-receiving sheets of the present invention were prepared in the same manner as that of Example B1, except that the following inorganic ultrafine particle was used instead of the ultrafine particle of ZnO.

Example B2 . . . Ultrafine particle of $TiO_2$ (TTO-55; particle diameter: 200 to 500 Å; manufactured by Ishihara Sangyo Kaisha Ltd.)

Example B3 . . . Ultrafine particle of ZnO subjected to surface treatment (ZnO-100 manufactured by Sumitomo Cement Co., Ltd.)

Example B4 . . . Ultrafine particle of $TiO_2$ subjected to surface treatment (TTO-55 manufactured by Ishihara Sangyo Kaisha Ltd.)

EXAMPLE B5

A coating solution having the following composition was coated by means of a bar coater on the same substrate sheet as that used in Example B1 so that the coating thickness on a dry basis was 4.0 μm, and the resultant coating was dried.

| Composition of coating solution | |
|---|---|
| Polyester resin (Vylon 200 manufactured by Toyobo Co., Ltd.) | 20.0 parts |
| Methyl ethyl ketone/toluene (weight ratio = 1/1) | 160.0 parts |

Then, a coating solution having the following composition was coated by means of a bar coater on the above-described layer so that the coating thickness on a dry basis was 2.0 μm, and the resultant coating was dried, thereby providing the thermal transfer sheet of the present invention.

| Composition of coating solution | |
|---|---|
| Polyester resin (Vylon 200 manufactured by Toyobo Co., Ltd.) | 10.0 parts |
| Ultrafine particle ZnO (ZnO-100; manufactured by Sumitomo Cement Co., Ltd.) | 10.0 parts |
| Catalytic crosslinking silicone (X-62-1212 manufactured by The Shin-Etsu Chemical Co., Ltd.) | 2.0 parts |
| Platinum-based curing catalyst (PL-50T manufactured by The Shin-Etsu Chemical Co., Ltd.) | 0.2 part |
| Methyl ethyl ketone/toluene (weight ratio = 1/1) | 160.0 parts |

EXAMPLES B6 TO B8

Thermal transfer image-receiving sheets of the present invention were prepared in the same manner as that of Example B5, except that the following inorganic ultrafine particle was used instead of the ultrafine particle of ZnO.

Example B6 . . . Ultrafine particle of $TiO_2$ (TTO-55; manufactured by Ishihara Sangyo Kaisha Ltd.)

Example B7 . . . Ultrafine particle of ZnO subjected to surface treatment (ZnO-100 manufactured by Sumitomo Cement Co., Ltd.)

Example B8 . . . Ultrafine particle of $TiO_2$ subjected to surface treatment (TTO-55 manufactured by Ishihara Sangyo Kaisha Ltd.)

Comparative Example B4

A comparative thermal transfer image-receiving sheet was prepared in the same manner as that of Example B5, except that an organic low molecular weight ultraviolet absorber (Tinuvin-P manufactured by Ciba-Geigy Aktiengesellschaft) was used instead of the ultrafine particle of ZnO, and the formation of an image and the evaluation of the formed image were conducted in the same manner as that of Example B5.

Comparative Example B5

A comparative thermal transfer image-receiving sheet was prepared in the same manner as that of Example B5, except that an organic low molecular weight ultraviolet absorber (Chemisorb 10 manufactured by Chemipuro Kasei K.K.) was used instead of the ultrafine particle of ZnO, and the formation of an image and the evaluation of the formed image was conducted in the same manner as that of Example B5.

EXAMPLE B9

A coating solution having the following composition was coated by means of a bar coater on the same substrate sheet as that used in Example B1 so that the coating thickness on a dry basis was 4.0 μm, and the resultant coating was dried.

| Composition of coating solution | |
|---|---|
| Polyester resin (Vylon 200 manufactured by Toyobo Co., Ltd.) | 10.0 parts |
| Ultrafine particle ZnO (ZnO-100; manufactured by Sumitomo Cement Co., Ltd.) | 10.0 Parts |
| Methyl ethyl ketone/toluene (weight ratio = 1/1) | 80.0 parts |

Then, a coating solution having the following composition was coated by means of a bar coater on the above-described layer so that the coating thickness on a dry basis was 2.0 μm, and the resultant coating was dried, thereby providing the thermal transfer sheet of the present invention.

| Composition of coating solution | |
|---|---|
| Polyester resin (GXP-23 manufactured by Toyobo Co., Ltd.) | 10.0 parts |
| Catalytic crosslinking silicone (X-62-1212 manufactured by The Shin-Etsu Chemical Co., Ltd.) | 1.0 parts |
| Platinum-based curing catalyst (PL-50T manufactured by The Shin-Etsu Chemical Co., Ltd.) | 0.1 part |
| Methyl ethyl ketone/toluene (weight ratio = 1/1) | 90.0 parts |

EXAMPLES B10 TO B12

Thermal transfer image-receiving sheets of the present invention were prepared in the same manner as that of Example B9, except that the following inorganic ultrafine particle and organic ultraviolet absorber were used instead of the ultrafine particle of ZnO.

Example B10 . . . Ultrafine particle of $TiO_2$ (TTO-55; manufactured by Ishihara Sangyo Kaisha Ltd.)

Example B11 . . . Ultrafine particle of ZnO subjected to surface treatment (ZnO-100 manufactured by Sumitomo Cement Co., Ltd.)

Example B12 . . . Ultrafine particle of $TiO_2$ subjected to surface treatment (TTO-55 manufactured by Ishihara Sangyo Kaisha Ltd.)

EXAMPLE B13

A coating solution having the following composition was coated by means of a bar coater on the same substrate sheet as that used in Example B1 so that the coating thickness on a dry basis was 4.0 μm, and the resultant coating was dried.

| Composition of coating solution | |
|---|---|
| Polyester resin (Vylon 200 manufactured by Toyobo Co., Ltd.) | 100 parts |
| Sol of $TiO_2$ subjected to surface treatment ($SiO_2$ coating treatment) | 100 parts |

Then, a coating solution having the following composition was coated by means of a bar coater on the above-described layer so that the coating thickness on a dry basis was 2.0 μm, and the resultant coating was dried, thereby providing the thermal transfer sheet of the present invention.

| Composition of coating solution | |
|---|---|
| Polyester resin (GXP-23 manufactured by Toyobo Co., Ltd.) | 10.0 parts |
| Catalytic crosslinking silicone (X-62-1212 manufactured by The Shin-Etsu Chemical Co., Ltd.) | 1.0 parts |
| Platinum-based catalyst (PL-50T manufactured by The Shin-Etsu Chemical-Co., Ltd.) | 0.1 part |
| Methyl ethyl ketone/toluene (weight ratio = 1/1) | 90.0 parts |

TABLE B1

| Ex. No. | Retention after xenon irradiation (%) 400 KJ/m² | 500 KJ/m² | Storage stability | Overall evaluation |
|---|---|---|---|---|
| Ex. B1 | ○ | Δ | ○ | ○ |
| Ex. B2 | ○ | Δ | ○ | ○ |
| Ex. B3 | ○ | ○ | ○ | ○ |
| Ex. B4 | ○ | ○ | ○ | ○ |
| Ex. B5 | ○ | Δ | ○ | ○ |
| Ex. B6 | ○ | Δ | ○ | ○ |
| Ex. B7 | ○ | ○ | ○ | ○ |
| Ex. B8 | ○ | ○ | ○ | ○ |
| Ex. B9 | ◎ | ○ | ○ | ◎ |
| Ex. B10 | ◎ | ○ | ○ | ◎ |
| Ex. B11 | ◎ | ◎ | ○ | ◎ |
| Ex. B12 | ◎ | ◎ | ○ | ◎ |
| Ex. B13 | ○ | ○ | ○ | ○ |
| Comp. Ex. B1 | X | XX | X | XX |
| Comp. Ex. B2 | Δ | X | X | X |
| Comp. Ex. B3 | Δ | X | X | X |
| Comp. Ex. B4 | Δ | X | X | X |
| Comp. Ex. B5 | Δ | X | X | X |

TABLE B2

| Ex. No. | Spectral reflectance at 370 nm (%) |
|---|---|
| Ex. B9 | 10 |
| Ex. B10 | 18 |
| Ex. B11 | 8 |
| Ex. B12 | 17 |
| Ex. B13 | 15 |
| Comp. Ex. B1 | 96 |

As described particularly in Examples B9 to B13, the provision of a layer having a capability of absorbing an ultraviolet radiation between the substrate sheet and the dye-receiving layer is particularly useful as compared with the provision of such a layer within the receiving layer per se or on the surface of the receiving layer. The reason for this is believed to reside in that the ultraviolet absorber layer prevents such an phenomenon that an ultraviolet radiation which has been passed through a receiving layer and reached a white substrate sheet reflects and again scatters in the receiving layer.

An integrating sphere attachment (internal type: 60 mmø; equipped with a photomultiplier tube $R_{928}$) was inserted into a sample chamber of Shimdzu self-recording spectrophotometer UV-240, and the spectral reflectance of reflected light from the substrate sheets of Examples B9 to B13 was measured. The results are given in Table B2.

The incorporation of an ultraviolet absorber comprising an inorganic ultrafine particle in a dye-receiving layer, the formation of a layer containing the ultraviolet absorber on the surface of the dye-receiving layer or the provision of a layer having a capability of adsorbing an ultraviolet radiation between the substrate sheet and the dye-receiving layer can provide a thermal transfer image-receiving sheet which can form a thermal transfer image having an excellent light fastness, is free from the bleedout of the ultraviolet absorber on the surface of the dye-receiving layer even during storage and can cut off the ultraviolet radiation reflected from the white substrate sheet.

EXAMPLE C1

Synthetic paper (Yupo-FRG-150 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coating thickness on a dry basis was 5.0 g/m², and the resultant coating was dried and irradiated in the air with an ultraviolet radiation from a 2-KW high pressure mercury lamp to form a dye-receiving layer, thereby providing the thermal transfer image-receiving sheet of the present invention.

| Composition of coating solution | |
|---|---|
| Polyester resin (Vylon 200 manufactured by Toyobo Co., Ltd.) | 15.0 parts |
| Reactive ultraviolet absorber (represented by the formula 1 wherein R = H and X = —$OCH_2CH_2$—) | 2.5 parts |
| Triethylene glycol diacrylate (Light Acrylate 3EG-A manufactured by Kyoeisha Chemical Co., Ltd.) | 10.0 parts |
| Mercapto-modified silicone oil (X-22-980 manufactured by The Shin-Etsu Chemical Co., Ltd.) | 1.0 parts |
| Ultraviolet polymerization initiator (Irgacure 183 manufactured by Ciba-Geigy Aktiengesellschaft) | 1.5 parts |
| Methyl ethyl ketone/toluene (weight ratio = 1/1) | 120.0 parts |

An ink composition for forming a dye-supporting layer was prepared according to the following formulation, coated by means of a gravure printing method on a 6 μm-thick polyethylene terephthalate film having a reverse face subjected to a treatment for imparting heat resistance so that the coverage on a dry basis was 1.0 g/m², and the resultant coating was dried to provide thermal transfer sheets.

| Ink composition | |
|---|---|
| Cyan dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

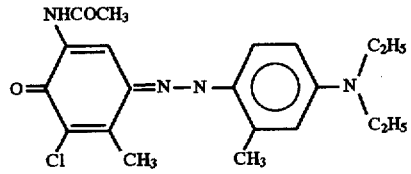

Thermal transfer test

The above-described thermal transfer sheet and the above-described thermal transfer image-receiving sheet of the present invention or comparative thermal transfer image-receiving sheet were put on top of the other in such a manner that the dye layer and the dye receiving surface faced each other. Recording of a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and the durability and storage stability of the formed image were then determined. The results are given in the following Table C1.

Various types of performance given in Table C1 were evaluated by the following methods.

(1) Light fastness test:

Irradiation of the print was conducted by means of a xenon fadeometer (Ci-35A manufactured by Atlas) at 200 $KJ/m^2$ and 300 $KJ/m^2$, the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

⊙: Retention was 80% or more.

○: Retention was 70 to 80% exclusive.

Δ: Retention was 60 to 70% exclusive.

X: Retention was less than 60%.

(2) Storage stability of thermal transfer sheet:

The storage stability was expressed in terms of the difference in the retention between when printing was conducted immediately after the thermal transfer sheet was prepared by the above-described method and the light fastness test was conducted and when the light fastness test was conducted after storage in an oven of 60° C. for 7 days.

○: No change in the retention was observed.

X: Reduction in the retention was observed.

Comparative Example C1

A comparative thermal transfer image-receiving sheet was prepared in the same manner as that of Example C1, except that instead of the reactive organic ultraviolet absorber added to the coating solution for a receiving layer of Example C1, use was made of an equal amount of a benzotriazole ultraviolet absorber free from a reactive group (Tinuvin-328 manufactured by Ciba-Geigy Aktiengesellschaft). The results are given in Table C1.

Comparative Example C2

A comparative thermal transfer image-receiving sheet was prepared in the same manner as that of Example C1, except that instead of the reactive organic ultraviolet absorber added to the coating solution for a receiving layer of Example C1, use was made of an equal amount of a benzophenone ultraviolet absorber free from a reactive group (Chemisorb 112manufactured by Chemipuro Kasei K.K.). The results are given in Table C1.

EXAMPLE C2

A thermal transfer image-receiving sheet was prepared in the same manner as that of Example C1, except that in the coating solution for a receiving layer, no ultraviolet polymerization initiator was used and irradiation of 5 Mrad was conducted at 175 KeV, 10 mA and a rate of 10 m/rain by means of an electrocurtain type electron beam irradiator. The results are given in the following Table C1.

EXAMPLE C3

A thermal transfer image-receiving sheet was prepared in the same manner as that of Example C1, except that instead of the polyester resin added to the coating solution for a receiving layer of Example C1, use was made of an equal amount of a polyvinyl acetal resin (S-lec KS-1 manufactured by Sekisui Chemical Co., Ltd.). The results are given in Table C1.

EXAMPLE C4

A thermal transfer image-receiving sheet was prepared in the same manner as that of Example C1, except that instead of the polyester resin added to the coating solution for a receiving layer of Example C1, use was made of an equal amount of a vinyl chloride/vinyl acetate copolymer (VYHH manufactured by Union Carbide). The results are given in Table C1.

EXAMPLE C5

A thermal transfer image-receiving sheet was prepared in the same manner as that of Example C2, except that the following coating solution was used instead of the coating solution for a receiving layer used in Example C1. The results are given in Table C1.

| Composition of coating solution | |
|---|---|
| Polyester resin (Vylon 200 manufactured by Toyobo Co., Ltd.) | 15.0 parts |
| Reactive ultraviolet absorber (represented by the formula 2 wherein R = $CH_3$; Adeka Stab LA-22 manufactured by Asahi Denka K.K.) | 2.5 parts |
| Triethylene glycol diacrylate (Light Acrylate 3EG-A manufactured by Kyoeisha Chemical Co., Ltd.) | 10.0 parts |
| Catalytic curing silicone oil (X-62-1212 manufactured by The Shin-Etsu Chemical Co., Ltd.) | 3.0 parts |
| Platinum-based catalyst (PL-50T manufactured by The Shin-Etsu Chemical Co., Ltd.) | 0.3 part |
| Methyl ethyl ketone/toluene (weight ratio = 1/1) | 120.0 parts |

EXAMPLE C6

A thermal transfer image-receiving sheet was prepared in the same manner as that of Example C5, except that instead of the polyester resin added to the coating solution for a receiving layer of Example C5, use was made of an equal amount of a polyvinyl acetal resin (S-lec KS-1 manufactured by Sekisui Chemical Co., Ltd.). The results are given in Table C1.

EXAMPLE C7

A thermal transfer image-receiving sheet was prepared in the same manner as that of Example C5, except that instead of the polyester resin added to the coating solution for a receiving layer of Example C5, use was made of an equal amount of a vinyl chloride/vinyl acetate copolymer (VYHH manufactured by Union Carbide). The results are given in Table C1.

EXAMPLE C8

A thermal transfer image-receiving sheet was prepared in the same manner as that of Example C1, except that 5.0 parts of pentaerythritol triacrylate (Light Acrylate PE-3A manufactured by Kyoeisha Chemical Co., Ltd.) was used instead of triethylene glycol diacrylate added to the coating solution for a receiving layer of Example C1. The results are given in Table C1.

EXAMPLE C9

The following coating solution was used instead of the coating solution used in Example C1, and coating and drying were conducted in the same manner as that of Example C1. The coating was aged at 100° C. for 60 min to form a dye-receiving layer, thereby providing the thermal transfer image-receiving sheet of the present invention. The thermal transfer image-receiving sheet was evaluated in the same manner as that of Example C1. The results are given in Table C1.

| Composition of coating solution | |
|---|---|
| Vinyl chloride/vinyl acetate/ vinyl alcohol copolymer (VAGH manufactured by Union Carbide) | 15.0 parts |
| Reactive ultraviolet absorber (represented by the formula 3; UVINUL X-19 manufactured by BASF) | 2.0 parts |
| Polyisocyanate (Coronate HK manufactured by Nippon Polyurethane Industry Co., Ltd.) | 3.0 parts |
| Alcohol-modified silicone oil (BY16-027 manufactured by Toray Silicone Co., Ltd.) | 2.0 parts |
| Dibutyltin laurate | $10^{-2}$ part |
| Methyl ethyl ketone/toluene (weight ratio = 1/1) | 120.0 parts |

Comparative Example C3

The following coating solution was used instead of the coating solution used in Example C9, and coating and drying were conducted in the same manner as that of Example C9. The coating was aged at 120° C. for 3 min to form a dye-receiving layer, thereby providing a comparative thermal transfer image-receiving sheet. The thermal transfer image-receiving sheet was evaluated in the same manner as that of Example C9. The results are given in Table C1.

| Composition of coating solution | |
|---|---|
| Vinyl chloride/vinyl acetate/ vinyl alcohol copolymer (VAGH manufactured by Union Carbide) | 15.0 parts |
| Reactive ultraviolet absorber (represented by the formula 3; UVINUL X-19 manufactured by BASF) | 2.0 parts |
| Catalytic curing silicone oil (X-62-1212 manufactured by The Shin-Etsu Chemical Co., Ltd.) | 3.0 Parts |
| Platinum-based catalyst (PL-50T manufactured by The Shin-Etsu Chemical Co., Ltd.) | 0.3 part |
| Metyl ethyl ketone/toluene (weight ratio = 1/1) | 120.0 parts |

EXAMPLE C10

A thermal transfer image-receiving sheet was prepared in the same manner as that of Example C9, except that instead of the vinyl chloride/vinyl acetate/vinyl alcohol copolymer (VAGH manufactured by Union Carbide) added to the coating solution for a receiving layer of Example C9, use was made of an equal amount of a polyvinyl acetal resin (S-lec KS-1 manufactured by Sekisui Chemical Co., Ltd.). The results are given in Table C1.

EXAMPLE C11

A thermal transfer image-receiving sheet was prepared in the same manner as that of Example C9, except that instead of the vinyl chloride/vinyl acetate/vinyl alcohol copolymer (VAGH manufactured by Union Carbide) added to the coating solution for a receiving layer of Example C9, use was made of an equal amount of a hydroxyethyl methacrylate/methyl methacrylate/ethyl methacrylate copolymer (molar ratio of comonomers=2:5:3). The results are given in Table C1.

TABLE C1

| Ex. No. | Retention after xenon irradiation (%) 200 KJ/m² | 300 KJ/m² | Storage stability | Overall evaluation |
|---|---|---|---|---|
| Ex. C1 | ◎ | ○ | ○ | ○ |
| Ex. C2 | ◎ | ○ | ○ | ○ |
| Ex. C3 | ◎ | ◎ | ○ | ○ |
| Ex. C4 | ◎ | ◎ | ○ | ○ |
| Ex. C5 | ◎ | ○ | ○ | ○ |
| Ex. C6 | ◎ | ◎ | ○ | ○ |
| Ex. C7 | ◎ | ◎ | ○ | ○ |
| Ex. C8 | ◎ | ○ | ○ | ○ |
| Ex. C9 | ◎ | ○ | ○ | ○ |
| Ex. C10 | ◎ | ◎ | ○ | ○ |
| Ex. C11 | ◎ | ○ | ○ | ○ |
| Comp. Ex. C1 | ○ | Δ | X | X |
| Comp. Ex. C2 | ○ | Δ | X | X |
| Comp. Ex. C3 | ○ | Δ | X | X |

As described above, according to the present invention, the thermal transfer image-receiving sheet having a dye-receiving layer to which a reactive ultraviolet absorber has been fixed through a reaction by means of an ionizing radiation or heat is much superior to the case where use is made of other ultraviolet absorber in the fastness of a sublimable dye image as well as in the stability of the ultraviolet absorber in the dye-receiving layer during storage.

Further, since the molecular weight of the reactive ultraviolet absorber is increased in the dye-receiving layer, the following features are attained.

It is possible to remarkably alleviate the volatility and extractability which are drawbacks of the conventional benzotriazole and benzophenone ultraviolet absorbers.

The ultraviolet absorber within the dye-receiving layer, as such, has an excellent heat resistance. Therefore, no deterioration in the effect of the ultraviolet absorber occurs even when the thermal transfer image-receiving sheet per se and sublimable transfer image are stored for a long period of time.

EXAMPLE D1

Synthetic paper (Yupo-FRG-1S0 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coverage on a dry basis was 5.0 g/m², and the resultant coating was dried to form a dye-receiving layer, thereby providing the thermal transfer image-receiving sheet of the present invention and a comparative thermal transfer image-receiving sheet.

| Composition of coating solution | |
|---|---|
| Polycarbonate resin (CAM1035 manufactured by Mitsubishi Gas Chemical Company, Inc.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Compound listed in Tables D1 to D4 | 1.0 part |
| Methyl ethyl ketone/toluene (weight ratio = 1/1) | 90.0 parts |

Separately, an ink composition for forming dye-supporting layer was prepared according to the following formulation, coated by means of a gravure printing method on a 6 μm-thick polyethylene terephthalate film having a reverse face subjected to a treatment for rendering the face heat-resistant so that the coverage on a dry basis was 1.0 g/m$^2$, and the resultant coating was dried to provide a thermal transfer sheet for use in the present invention.

| Ink composition | |
|---|---|
| Magenta dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

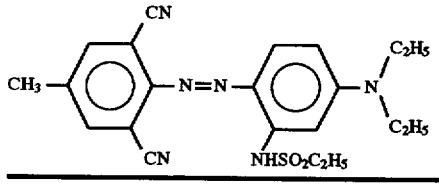

EXAMPLE D2

Synthetic paper (Yupo-FRG-150 (thickness: 150 manufactured by Oji-Yuka Synthetic Paper Co., Ltd.) was used as the substrate sheet, and a coating solution having the following composition was coated by means of a bar coater on one surface of the synthetic paper so that the coverage on a dry basis was 5.0 g/m$^2$, and the resultant coating was dried to form a dye-receiving layer, thereby providing the thermal transfer image-receiving sheet of the present invention and a comparative thermal transfer image-receiving sheet.

| Composition of coating solution | |
|---|---|
| Polyester resin (GXP-23 manufactured by Toyobo Co., Ltd.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Compound listed in Tables D1 to D4 | 1.0 part |
| Chloroform | 90.0 parts |

Separately, an ink composition for forming a dye-supporting layer was prepared according to the following formulation, coated by means of a gravure printing method on a 6 μm-thick polyethylene terephthalate film having a reverse face subjected to a treatment for imparting heat resistance so that the coverage on a dry basis was 1.0 g/m$^2$, and the resultant coating was dried to provide a thermal transfer sheet for use in the present invention.

| Ink composition | |
|---|---|
| Cyan dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

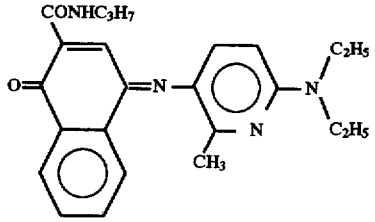

Thermal transfer test

The above-described thermal transfer sheet and the above-described thermal transfer image-receiving sheet of the present invention or comparative thermal transfer image-receiving sheet were put on top of the other in such a manner that the dye layer and the dye receiving surface faced each other. Recording of a magenta image and a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and the durability and storage stability of the formed image were then determined. The results are given in the following Tables D5 to D11.

Various types of performance given in Tables D5 to D11 were evaluated by the following methods.

(1) Light fastness test:

Irradiation of the print was conducted by means of a xenon fadeometer (Ci-35A manufactured by Atlas) at 200 KJ/m$^2$ and 300 KJ/m$^2$, the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

⊙: Retention was 80% or more.

○: Retention was 70 to 80% exclusive.

Δ: Retention was 60 to 70% exclusive.

X: Retention was less than 60%.

(2) Storage stability of thermal transfer sheet before printing:

The storage stability was expressed in terms of the difference in the retention between when printing was conducted immediately after the thermal transfer sheet was prepared by the above-described method and the light fastness test was conducted and when the light fastness test was conducted after storage in an oven of 60° C. for 7 days.

○: No change in the retention was observed.

X: Reduction in the retention was observed.

Comparative Examples D1 to D8

A comparative thermal transfer image-receiving sheet was prepared in the same manner as that of Example D1, except that instead of the compound added to the coating solution for a receiving layer of Example D1, use was made of an equal amount of comparative ultraviolet absorbers D1 to D8. The results are given in Table D11.

Comparative Examples D9 to D16

A comparative thermal transfer image-receiving sheet was prepared in the same manner as that of Example D2, except that instead of the compound added to the coating solution for a receiving layer of Example D2, use was made of an equal amount of the above-described comparative ultraviolet absorbers D1 to D8. The results are given in Table D12.

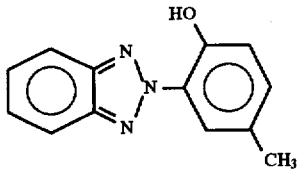

Comp. Ex. D1

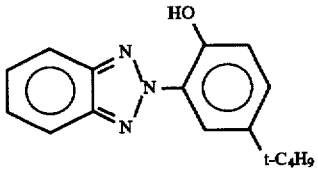

Comp. Ex. D2

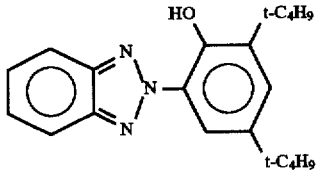

Comp. Ex. D3

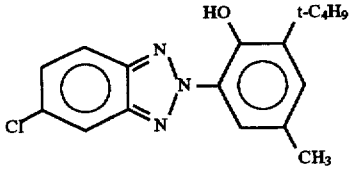

Comp. Ex. D4

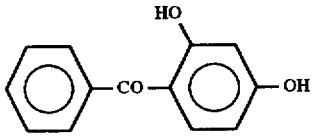

Comp. Ex. D5

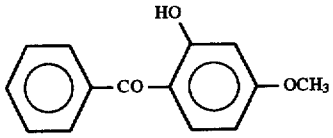

Comp. Ex. D6

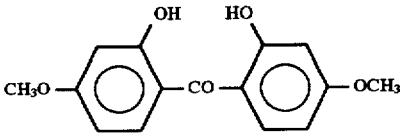

Comp. Ex. D7

-continued

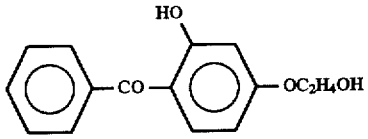

Comp. Ex. D8

TABLE D5

| Compd. used in Examples | Retention after xenon irradiation (%) 200 KJ/m² | 300 KJ/m² | Storage stability | Overall evaluation |
|---|---|---|---|---|
| 1-a-1 | ◎ | ○ | ○ | ◎ |
| 1-a-2 | ◎ | ○ | ○ | ◎ |
| 1-a-3 | ◎ | ○ | ○ | ◎ |
| 1-a-4 | ◎ | ○ | ○ | ◎ |
| 1-a-5 | ◎ | ○ | ○ | ◎ |
| 1-a-6 | ◎ | ○ | ○ | ◎ |
| 1-b-1 | ◎ | ○ | ○ | ◎ |
| 1-b-2 | ◎ | ○ | ○ | ◎ |
| 1-b-3 | ○ | ○ | ○ | ◎ |
| 1-b-4 | ◎ | ○ | ○ | ◎ |
| 1-b-5 | ◎ | ○ | ○ | ◎ |
| 1-b-6 | ◎ | ○ | ○ | ◎ |
| 1-b-7 | ◎ | Δ | ○ | ◎ |
| 1-b-8 | ○ | Δ | ○ | ◎ |
| 1-b-9 | ◎ | ○ | ○ | ◎ |
| 1-b-10 | ◎ | ○ | ○ | ◎ |
| 1-b-11 | ◎ | ○ | ○ | ◎ |
| 1-b-12 | ◎ | ○ | ○ | ◎ |
| 1-b-13 | ◎ | ○ | ○ | ◎ |
| 1-b-14 | ◎ | ○ | ○ | ◎ |
| 1-b-15 | ◎ | ○ | ○ | ◎ |
| 1-b-16 | ◎ | ○ | ○ | ◎ |

TABLE D6

| Compd. used in Examples | Retention after xenon irradiation (%) 200 KJ/m² | 300 KJ/m² | Storage stability | Overall evaluation |
|---|---|---|---|---|
| 1-c-1 | ◎ | ○ | ○ | ◎ |
| 1-c-2 | ◎ | ○ | ○ | ◎ |
| 1-c-3 | ◎ | Δ | ○ | ◎ |
| 1-c-4 | ◎ | ○ | ○ | ◎ |
| 1-c-5 | ○ | Δ | ○ | ◎ |
| 1-c-6 | ◎ | ○ | ○ | ◎ |
| 2-1 | ◎ | ○ | ○ | ◎ |
| 2-2 | ◎ | ○ | ○ | ◎ |
| 2-3 | ◎ | ○ | ○ | ◎ |
| 2-4 | ◎ | ○ | ○ | ◎ |
| 2-5 | ◎ | ○ | ○ | ◎ |
| 2-6 | ◎ | Δ | ○ | ◎ |
| 2-7 | ○ | Δ | ○ | ◎ |
| 2-8 | ○ | ○ | ○ | ◎ |
| 2-9 | ○ | ○ | ○ | ◎ |
| 2-10 | ○ | ○ | ○ | ◎ |
| 2-11 | ○ | ○ | ○ | ◎ |
| 2-12 | ○ | Δ | ○ | ◎ |
| 2-13 | ○ | ○ | ○ | ◎ |
| 2-14 | ○ | ○ | ○ | ◎ |
| 2-15 | ○ | ○ | ○ | ◎ |
| 2-16 | ○ | ○ | ○ | ◎ |
| 2-17 | ○ | ○ | ○ | ◎ |
| 2-18 | ○ | ○ | ○ | ◎ |

TABLE D7

| Compd. used in Examples | Retention after xenon irradiation (%) 200 KJ/m² | 300 KJ/m² | Storage stability | Overall evaluation |
|---|---|---|---|---|
| 2-19 | ◎ | ○ | ○ | ◎ |
| 2-20 | ◎ | ○ | ○ | ◎ |
| 2-21 | ◎ | Δ | ○ | ◎ |
| 2-22 | ◎ | ○ | ○ | ◎ |
| 2-23 | ◎ | ○ | ○ | ◎ |

TABLE D8

| Compd. used in Examples | Retention after xenon irradiation (%) 200 KJ/m² | 300 KJ/m² | Storage stability | Overall evaluation |
|---|---|---|---|---|
| 1-a-1 | ◎ | ○ | ○ | ◎ |
| 1-a-2 | ◎ | ○ | ○ | ◎ |
| 1-a-3 | ◎ | ○ | ○ | ◎ |
| 1-a-4 | ○ | ○ | ○ | ◎ |
| 1-a-5 | ◎ | ○ | ○ | ◎ |
| 1-a-6 | ◎ | ○ | ○ | ◎ |
| 1-b-1 | ◎ | ○ | ○ | ◎ |
| 1-b-2 | ◎ | ○ | ○ | ◎ |
| 1-b-3 | ◎ | ○ | ○ | ◎ |
| 1-b-4 | ◎ | ○ | ○ | ◎ |
| 1-b-5 | ◎ | ○ | ○ | ◎ |
| 1-b-6 | ◎ | ○ | ○ | ◎ |
| 1-b-7 | ◎ | ○ | ○ | ◎ |
| 1-b-8 | ◎ | Δ | ○ | ◎ |
| 1-b-9 | ◎ | ○ | ○ | ◎ |
| 1-b-10 | ◎ | ○ | ○ | ◎ |
| 1-b-11 | ◎ | ○ | ○ | ◎ |
| 1-b-12 | ◎ | ○ | ○ | ◎ |
| 1-b-13 | ◎ | ○ | ○ | ◎ |
| 1-b-14 | ◎ | ○ | ○ | ◎ |
| 1-b-15 | ◎ | ○ | ○ | ◎ |
| 1-b-16 | ◎ | Δ | ○ | ◎ |

TABLE D9

| Compd. used in Examples | Retention after xenon irradiation (%) 200 KJ/m² | 300 KJ/m² | Storage stability | Overall evaluation |
|---|---|---|---|---|
| 1-c-1 | ◎ | ○ | ○ | ◎ |
| 1-c-2 | ○ | Δ | ○ | ◎ |
| 1-c-3 | ◎ | ○ | ○ | ◎ |
| 1-c-4 | ◎ | ○ | ○ | ◎ |
| 1-c-5 | ◎ | Δ | ○ | ◎ |
| 1-c-6 | ◎ | ○ | ○ | ◎ |
| 2-1 | ◎ | ○ | ○ | ◎ |
| 2-2 | ◎ | ○ | ○ | ◎ |
| 2-3 | ◎ | ○ | ○ | ◎ |
| 2-4 | ◎ | ○ | ○ | ◎ |
| 2-5 | ◎ | ○ | ○ | ◎ |
| 2-6 | ◎ | ○ | ○ | ◎ |
| 2-7 | ◎ | ○ | ○ | ◎ |
| 2-8 | ◎ | Δ | ○ | ◎ |
| 2-9 | ◎ | ○ | ○ | ◎ |
| 2-10 | ◎ | ○ | ○ | ◎ |
| 2-11 | ◎ | ○ | ○ | ◎ |
| 2-12 | ○ | Δ | ○ | ◎ |
| 2-13 | ◎ | ○ | ○ | ◎ |
| 2-14 | ◎ | ○ | ○ | ◎ |
| 2-15 | ◎ | ○ | ○ | ◎ |
| 2-16 | ◎ | ○ | ○ | ◎ |
| 2-17 | ◎ | ○ | ○ | ◎ |
| 2-18 | ◎ | ○ | ○ | ◎ |

TABLE D10

| Compd. used in Examples | Retention after xenon irradiation (%) 200 KJ/m² | 300 KJ/m² | Storage stability | Overall evaluation |
|---|---|---|---|---|
| 2-19 | ◎ | ○ | ○ | ◎ |
| 2-20 | ◎ | ○ | ○ | ◎ |
| 2-21 | ◎ | ○ | ○ | ◎ |
| 2-22 | ◎ | ○ | ○ | ◎ |
| 2-23 | ◎ | ○ | ○ | ◎ |

TABLE D11

| Comp. Ex. | Retention after xenon irradiation (%) 200 KJ/m² | 300 KJ/m² | Storage stability | Overall evaluation |
|---|---|---|---|---|
| 1 | ○ | Δ | X | X |
| 2 | ○ | Δ | X | X |
| 3 | ○ | Δ | X | Δ |
| 4 | ◎ | Δ | X | X |
| 5 | ○ | Δ | X | X |
| 6 | ○ | Δ | X | X |
| 7 | ◎ | Δ | X | Δ |
| 8 | ○ | Δ | X | X |
| 9 | ○ | X | X | X |
| 10 | ◎ | ○ | X | X |
| 11 | ○ | Δ | X | Δ |
| 12 | ○ | X | X | X |
| 13 | ○ | Δ | X | X |
| 14 | ○ | Δ | X | Δ |
| 15 | ○ | Δ | X | Δ |
| 16 | Δ | X | X | X |

As described above, according to the present invention, as a result of studies of the light fastness and other storage stability of a sublimable transfer image formed by thermal transfer with respect to-various ultraviolet absorbers, antioxidants, photostabilizers, etc., it has become apparent that thermal transfer image-receiving sheet provided with a receiving layer containing benzotriazole and benzophenone ultraviolet absorbers represented by the structural formulae (1) and (2) are much superior to the case where use is made of other ultraviolet absorber in the fastness of a sublimable dye image as well as in the stability of the ultraviolet absorber in the dye-receiving layer during storage.

Further, since the molecular weight of the reactive ultraviolet absorber is increased in the dye-receiving layer, the following features are attained.

It is possible to remarkably alleviate the volatility and extractability which are drawbacks of the conventional benzotriazole and benzophenone ultraviolet absorbers.

The ultraviolet absorber within the dye-receiving layer, as such, has an excellent heat resistance. Therefore, no deterioration in the effect of the ultraviolet absorber occurs even when the thermal transfer image-receiving sheet per se and sublimable transfer image are stored for a long period of time.

EXAMPLE E1

Synthetic paper (Yupo-FRG-150 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coverage on a dry basis was 5.0 g/m², and the resultant coating was dried to form a dye-receiving layer, thereby providing the thermal transfer image-receiving sheet of the present invention and a comparative thermal transfer image-receiving sheet.

| Composition of coating solution | |
|---|---|
| Polycarbonate resin (CAM1035 manufactured by Mitsubishi Gas Chemical Company, Inc.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Compound listed in Tables E1 and E2 | 1.0 part |
| Methyl ethyl ketone/toluene (weight ratio = 1/1) | 90.0 parts |

Separately, an ink composition for forming a dye-supporting layer was prepared according to the following formulation, coated by means of a gravure printing method on a 6 μm-thick polyethylene terephthalate film having a reverse face subjected to a treatment for imparting heat resistance so that the coverage on a dry basis was 1.0 g/m$^2$, and the resultant coating was dried to provide a thermal transfer sheet for use in the present invention.

| Ink composition | |
|---|---|
| Magenta dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

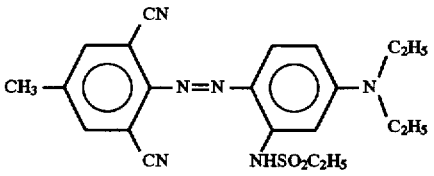

EXAMPLE E2

Synthetic paper (Yupo-FRG-150 (thickness: 150 μm) manufactured by Oji-Yuka Synthetic Paper Co., Ltd.) was used as the substrate sheet, and a coating solution having the following composition was coated by means of a bar coater on one surface of the-synthetic paper so that the coverage on a dry basis was 5.0 g/m$^2$, and the resultant coating was dried to form a dye-receiving layer, thereby providing the thermal transfer image-receiving sheet of the present invention and a comparative thermal transfer image-receiving sheet.

| Composition of coating solution | |
|---|---|
| Polyester resin (GXP-23 manufactured by Toyobo Co., Ltd.) | 10.0 parts |
| Catalytic crosslinking silicone (X-62-1212 manufactured by The Shin-Etsu Chemical Co., Ltd.) | 1.0 part |
| Platinum-based curing catalyst (PL-50T manufactured by The Shin-Etsu Chemical Co., Ltd.) | 0.1 part |
| Compound listed in Tables E1 and E2 | 1.0 part |
| Chloroform | 90.0 parts |

Separately, an ink composition for forming a dye-supporting layer was prepared according to the following formulation, coated by means of a gravure printing method on a 6 μm-thick polyethylene terephthalate film having a reverse face subjected to a treatment for imparting heat resistance so that the coverage on a dry basis was 1.0 g/m$^2$, and the resultant coating was dried to provide a thermal transfer sheet for use in the present invention.

| Ink composition | |
|---|---|
| Cyan dye represented by the following structural formula | 3 parts |
| Polyvinyl butyral resin (S-lec BX-1 manufactured by Sekisui Chemical Co., Ltd.) | 4 parts |
| Methyl ethyl ketone | 50 parts |
| Toluene | 43 parts |

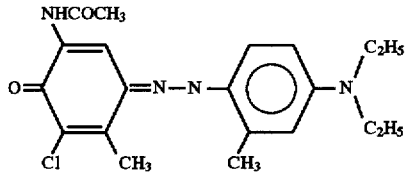

Thermal transfer test

The above-described thermal transfer sheet and the above-described thermal transfer image-receiving sheet of the present invention or comparative thermal transfer image-receiving sheet were put on top of the other in such a manner that the dye layer and the dye receiving surface faced each other. Recording of a magenta image and a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and the durability and storage stability of the formed image were then determined. The results are given in the following Tables E3 to E4.

Light fastness test:

Irradiation of the print was conducted by means of a xenon fadeometer (Ci-35A manufactured by Atlas) at 300 KJ/m$^2$ or 200 KJ/m$^2$, the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

⊙: Retention was 80% or more.

○: Retention was 70 to 80% exclusive.

Δ: Retention was 60 to 70% exclusive.

X: Retention was less than 60%.

Comparative Example E1

A comparative thermal transfer image-receiving sheet was prepared in the same manner as that of Example E1, except that instead of the compound added to the coating solution for a receiving layer of Example E1, use was made of an equal amount of the above-described comparative ultraviolet absorbers 1 to 4. The results are given in Table E5.

Comparative Example E2

A comparative thermal transfer image-receiving sheet was prepared in the same manner as that of Example E2, except that instead of the compound added to the coating solution for a receiving layer of Example E2, use was made of an equal amount of the above-described comparative ultraviolet absorbers 1 to 4. The results are given in Table E6.

Ultraviolet absorber 1:

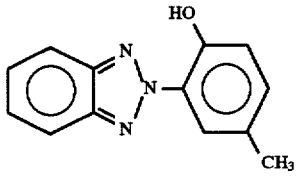

Ultraviolet absorber 2:

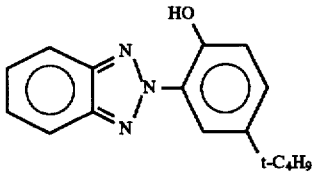

Ultraviolet absorber 3:

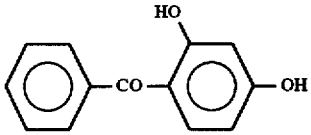

Ultraviolet absorber 4:

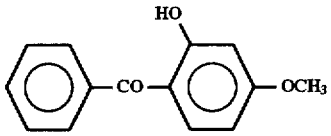

TABLE E1

(Ex. E1)

| Compd. | Photostability of magenta image 300 KJ | Photostability of cyan dye 300 KJ |
|---|---|---|
| Compd. 1 | ○ | ○ |
| Compd. 2 | ○ | ○ |
| Compd. 3 | ○ | ○ |
| Compd. 4 | ○ | ○ |
| Compd. 5 | ○ | ○ |
| Compd. 6 | ○ | ○ |
| Compd. 7 | ○ | ○ |
| Compd. 8 | ○ | ○ |
| Compd. 9 | ○ | ○ |
| Compd. 10 | ○ | ○ |
| Compd. 11 | ○ | ○ |
| Compd. 12 | ○ | ○ |
| Compd. 13 | ○ | ○ |
| Compd. 14 | ○ | ○ |
| Compd. 15 | ○ | ○ |
| Compd. 16 | ○ | Δ |
| Compd. 17 | ○ | Δ |
| Compd. 18 | ○ | Δ |

TABLE E4

(Ex. E2)

| Compd. | Photostability of magenta image 200 KJ | Photostability of cyan dye 200 KJ |
|---|---|---|
| Compd. 1 | ○ | ○ |
| Compd. 2 | ○ | ○ |
| Compd. 3 | ○ | ○ |
| Compd. 4 | ○ | ○ |
| Compd. 5 | ○ | ○ |
| Compd. 6 | ○ | ○ |
| Compd. 7 | ○ | ○ |
| Compd. 8 | ○ | ○ |
| Compd. 9 | ○ | ○ |
| Compd. 10 | ○ | ○ |
| Compd. 11 | ○ | ○ |
| Compd. 12 | ○ | ○ |
| Compd. 13 | ○ | ○ |
| Compd. 14 | ○ | ○ |
| Compd. 15 | ○ | ○ |
| Compd. 16 | Δ | Δ |
| Compd. 17 | Δ | Δ |
| Compd. 18 | Δ | Δ |

TABLE E5

(Comp. Ex. E1)

| Ultraviolet absorber | Magenta image | Cyan image |
|---|---|---|
| Ultraviolet absorber.1 | Δ | Δ |
| Ultraviolet absorber.2 | Δ | Δ |
| Ultraviolet absorber.3 | Δ | X |
| Ultraviolet absorber.4 | Δ | X |

TABLE E6

(Comp. Ex. E2)

| Ultraviolet absorber | Magenta image | Cyan image |
|---|---|---|
| Ultraviolet absorber 1 | X | X |
| Ultraviolet absorber 2 | ○ | Δ |
| Ultraviolet absorber 3 | Δ | X |
| Ultraviolet absorber 4 | Δ | X |

As described above, according to the present invention, as a result of studies of the light fastness and other storage stability of a sublimable transfer image formed by thermal transfer with respect to various ultraviolet absorbers, antioxidants, photostabilizers, etc., it has become apparent that thermal transfer image-receiving sheet provided with a receiving layer containing benzoylmethane derivative, benzylidene derivative and hydantoin ultraviolet absorbers represented by the structural formulae (1) to (4) are much superior to the case where use is made of other ultraviolet absorber in the fastness of a sublimable dye image as well as in the stability of the ultraviolet absorber in the dye-receiving layer during storage.

What is claimed is:

1. A thermal transfer image-receiving sheet comprising:

a substrate sheet; and a dye-receiving layer formed on at least one surface of said substrate sheet, said dye-receiving layer comprising a dye-receiving resin and an ultraviolet absorber reacted with and bonded to said dye-receiving resin.

2. The thermal transfer image-receiving sheet of claim 1, wherein said ultraviolet absorber comprises at least one member selected from the group consisting of compounds represented by the following formulae:

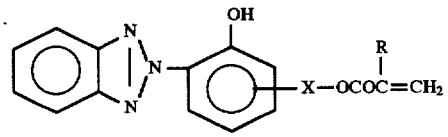

(1)

wherein R=H or $CH_3$ and X=—$OCH_2CH_2$— or $-CH_2\underset{\underset{OH}{|}}{C}HCH_2-$;

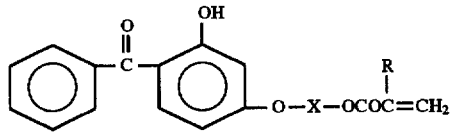

(2)

wherein R=H or $CH_3$ and X=—$CH_2CH_2$ or $-CH_2\underset{\underset{OH}{|}}{C}HCH_2$; and

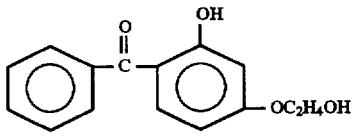

(3)

3. The thermal transfer image receiving sheet of claim 1, wherein said dye-receiving layer comprises at least one of a thermoplastic resin and an addition polymerizable monomer unit reacted with at least one ultraviolet absorber represented by the following formulae:

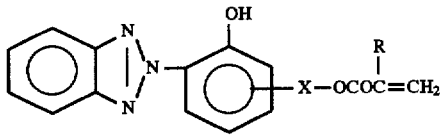

(1)

wherein R=H or $CH_3$ and X=—$OCH_2CH_2$—or $-CH_2\underset{\underset{OH}{|}}{C}HCH_2-$;

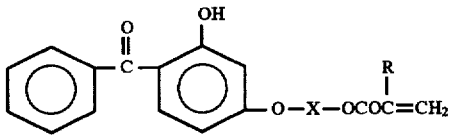

(2)

wherein R=H or $CH_3$ and X=—$CH_2CH_2$ or $-CH_2\underset{\underset{OH}{|}}{C}HCH_2-$.

4. The thermal transfer image-receiving sheet of claim 1, wherein said dye-receiving layer comprises a reactive ultraviolet absorber reacted with at least one of a polyisocyanate and a thermoplastic resin.

5. The thermal transfer image-receiving sheet of claim 1 wherein said dye-receiving layer comprises a reactive silicone releasing agent reacted with and bonded to a thermoplastic resin.

6. The thermal transfer image-receiving sheet of claim 4, wherein said reactive silicone releasing agent contains, as a reactive group, an addition-reactive double bond, an alcoholic hydroxyl group, a mercapto group, an amino group, a carboxyl group, an epoxy group or an isocyanate group.

* * * * *